US012458109B2

(12) United States Patent
Fuerst

(10) Patent No.: US 12,458,109 B2
(45) **Date of Patent: *Nov. 4, 2025**

(54) FOOTWEAR ARTICLE WITH WEAR GUARD

(71) Applicant: KEEN, Inc., Portland, OR (US)

(72) Inventor: Rory W. Fuerst, Atherton, CA (US)

(73) Assignee: KEEN, INC., Portland, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/412,965

(22) Filed: Jan. 15, 2024

(65) Prior Publication Data

US 2024/0148111 A1 May 9, 2024

Related U.S. Application Data

(62) Division of application No. 17/930,039, filed on Sep. 6, 2022, now Pat. No. 11,998,084, which is a division of application No. 16/798,234, filed on Feb. 21, 2020, now Pat. No. 11,464,291.

(60) Provisional application No. 62/809,491, filed on Feb. 22, 2019.

(51) Int. Cl.
*A43B 23/22* (2006.01)
*A43B 23/08* (2006.01)

(52) U.S. Cl.
CPC ..... *A43B 23/227* (2013.01); *A43B 23/081* (2013.01); *A43B 23/088* (2013.01)

(58) Field of Classification Search
CPC ..... A43B 23/227; A43B 23/26; A43B 23/027; A43B 23/081; A43B 7/32
See application file for complete search history.

(56) References Cited

U.S. PATENT DOCUMENTS

| | | | | |
|---|---|---|---|---|
| 1,974,543 | A * | 9/1934 | Reymond | A43B 1/0018 12/133 R |
| 2,615,261 | A | 10/1952 | Grotto | |
| 3,068,593 | A | 12/1962 | O'Donnell | |
| 3,102,347 | A | 9/1963 | Griswold et al. | |
| 3,108,386 | A | 10/1963 | MacQuaid | |
| 3,191,321 | A * | 6/1965 | Brutting | A43B 5/02 36/77 R |
| 4,194,310 | A | 3/1980 | Bowerman | |
| 4,366,629 | A * | 1/1983 | Scherz | A43B 7/32 36/76 R |
| D268,065 | S * | 3/1983 | Spreng | D2/908 |

(Continued)

FOREIGN PATENT DOCUMENTS

| | | |
|---|---|---|
| EP | 2071970 A1 | 6/2009 |
| EP | 1874149 B1 | 7/2013 |
| WO | 0064292 A1 | 11/2000 |

OTHER PUBLICATIONS

ISA Korean Intellectual Property Office, International Search Report and Written Opinion Issued in Application No. PCT/US2020/019362, Jul. 17, 2020, WIPO, 10 pages.

*Primary Examiner* — Jillian K Pierorazio
(74) *Attorney, Agent, or Firm* — McCoy Russell LLP

(57) ABSTRACT

A footwear article is provided comprising a wear guard, wherein the wear guard includes bellows. In at least one example, the bellows are spaced away from a toe of the footwear article. In one or more examples, the bellows extend along an edge of a lacing structure of the footwear article. Additionally or alternatively, the bellows may be positioned adjacent to a tongue of the footwear article.

20 Claims, 15 Drawing Sheets

(56) References Cited

U.S. PATENT DOCUMENTS 4,562,652 A * 1/1986 Hensler ..... A43B 1/0018 36/102
4,563,825 A * 1/1986 Tesser ..... A43B 7/06 36/3 R
D282,599 S * 2/1986 Frey ..... D2/911
D292,941 S * 12/1987 Kelley ..... D2/969
D292,943 S * 12/1987 Tong ..... D2/969
4,813,158 A 3/1989 Brown
4,908,963 A * 3/1990 Krajcir ..... A43C 13/14 36/77 R
D315,979 S * 4/1991 Legacki ..... D2/970
5,216,827 A 6/1993 Cohen
5,319,869 A 6/1994 McDonald et al.
5,353,526 A 10/1994 Foley et al.
5,457,898 A 10/1995 Fortin et al.
5,528,841 A * 6/1996 Pozzobon ..... A43B 5/0405 36/3 A
5,878,511 A 3/1999 Krajcir
6,012,236 A 1/2000 Pozzobon
6,170,174 B1 1/2001 Gesso
D451,271 S * 12/2001 Gerber ..... D2/972
D452,070 S * 12/2001 Holmes ..... D2/972
6,389,715 B1 5/2002 Krajcir
D468,520 S * 1/2003 Holmes ..... D2/972
6,631,569 B1 10/2003 Scharbius et al.
D503,523 S * 4/2005 Matis ..... D2/969
D512,214 S * 12/2005 Hatfield ..... D2/972
D517,306 S * 3/2006 Hoeft ..... D2/972
D520,723 S * 5/2006 Hoeft ..... D2/972
D523,217 S * 6/2006 Matis ..... D2/969
D532,194 S * 11/2006 Cessor ..... D2/972
D548,444 S * 8/2007 Covatch ..... D2/946
D575,948 S * 9/2008 St-Louis ..... D2/970
D575,949 S * 9/2008 St-Louis ..... D2/970
D579,647 S * 11/2008 Schoenborn ..... D2/970
D594,641 S * 6/2009 McDade ..... D2/976
7,650,703 B2 1/2010 Conolly
7,818,900 B2 10/2010 Cavasin
D639,543 S * 6/2011 Lamont ..... D2/907
D646,879 S * 10/2011 Huynh ..... D2/972
D646,880 S * 10/2011 Huynh ..... D2/972
D646,882 S * 10/2011 Huynh ..... D2/972
D668,858 S * 10/2012 Shaffer ..... D2/972
D693,106 S * 11/2013 James ..... D2/972
D709,280 S * 7/2014 Shaffer ..... D2/972
D711,088 S * 8/2014 Kirschner ..... D2/972
9,038,288 B2 5/2015 Droege et al.
9,179,732 B2 * 11/2015 Minami ..... A43B 5/025
D767,868 S * 10/2016 Johnsongriffin ..... D2/972
D782,806 S * 4/2017 Small ..... D2/972
D792,698 S * 7/2017 Kirschner ..... D2/972
9,737,114 B2 8/2017 Beye et al.
D809,277 S 2/2018 Wright
10,219,582 B2 3/2019 Spiller et al.
D849,375 S * 5/2019 Gewirz ..... D2/946
10,448,697 B2 * 10/2019 Ito ..... A43B 23/087
D867,728 S * 11/2019 Whittington ..... D2/902
10,779,615 B2 9/2020 Minami et al.
D905,939 S * 12/2020 Nikolov ..... D2/909
D927,837 S * 8/2021 Shahid ..... D2/970
D933,349 S * 10/2021 Schenone ..... D2/972
11,266,205 B2 3/2022 Benchoff et al.
2001/0022039 A1 9/2001 Krajcir
2001/0042324 A1 * 11/2001 Filice ..... A43B 23/047 36/102
2002/0144434 A1 10/2002 Farys et al.
2002/0184794 A1 12/2002 Peterson et al.
2003/0167658 A1 * 9/2003 Davis ..... A43B 5/025 36/128
2004/0016150 A1 1/2004 Labonte et al.
2004/0211090 A1 * 10/2004 Miller ..... A43B 23/24 36/97
2006/0021256 A1 2/2006 Hess
2006/0277787 A1 * 12/2006 Vattes ..... A43B 23/07 36/3 A
2007/0204481 A1 * 9/2007 Conolly ..... B63H 9/1007 36/8.1
2008/0115387 A1 5/2008 Walworth et al.
2008/0295263 A1 * 12/2008 Meschter ..... B29D 35/146 12/146 C
2009/0229144 A1 * 9/2009 Sussman ..... A43B 3/26 36/97
2011/0035963 A1 * 2/2011 Baker ..... A43B 13/40 36/114
2011/0078924 A1 * 4/2011 Rackiewicz ..... A43B 23/0255 12/142 E
2011/0099854 A1 5/2011 Foster
2011/0302727 A1 * 12/2011 Sokolowski ..... D04B 1/102 12/146 C
2012/0117738 A1 * 5/2012 Jarvis ..... A43B 13/41 12/142 T
2012/0180340 A1 * 7/2012 Crowley, II ..... A43B 1/0027 36/103
2012/0180341 A1 * 7/2012 Crowley, II ..... A43B 13/223 36/83
2013/0008053 A1 1/2013 Nishiwaki et al.
2013/0074374 A1 3/2013 Droege et al.
2013/0091730 A1 * 4/2013 Spiller ..... A43B 5/025 36/93
2014/0130380 A1 * 5/2014 Anderson ..... A43B 23/16 36/107
2014/0259760 A1 9/2014 Dojan et al.
2014/0259768 A1 * 9/2014 Spiller ..... A43B 7/32 36/87
2015/0150339 A1 * 6/2015 Van Hook ..... A43B 23/06 36/84
2015/0342294 A1 * 12/2015 Frappier ..... A43B 23/26 36/115
2016/0095389 A1 * 4/2016 Minami ..... A43B 23/0245 36/45
2016/0166009 A1 6/2016 Hatfield et al.
2016/0331072 A1 * 11/2016 Gould ..... A43C 13/14
2017/0071291 A1 3/2017 Follet et al.
2017/0215520 A1 * 8/2017 Spiller ..... A43B 3/0078
2017/0251762 A1 * 9/2017 Gu ..... A43B 23/0275
2017/0273404 A1 9/2017 Doenges et al.
2017/0367437 A1 * 12/2017 Ludemann ..... A43B 23/026
2018/0042337 A1 * 2/2018 Davis ..... A43B 23/026
2018/0116239 A1 5/2018 Kang
2018/0135213 A1 * 5/2018 Bell ..... D03D 15/56
2018/0263339 A1 * 9/2018 Neumann ..... A43B 3/0036
2018/0338565 A1 11/2018 Aguirre
2018/0360156 A1 12/2018 Whiteman et al.
2018/0368525 A1 * 12/2018 Iuchi ..... B32B 25/042
2019/0335858 A1 * 11/2019 Shin ..... A43B 23/081
2021/0321718 A1 10/2021 Chang

* cited by examiner

FOOTWEAR ARTICLE WITH WEAR GUARD

CROSS REFERENCE TO RELATED APPLICATIONS

The present application is a divisional of U.S. Non-Provisional patent application Ser. No. 17/930,039, entitled "FOOTWEAR ARTICLE WITH WEAR GUARD," and filed on Sep. 6, 2022, which is a divisional of application Ser. No. 16/798,234, entitled "FOOTWEAR ARTICLE WITH WEAR GUARD," and filed on Feb. 21, 2020. U.S. application Ser. No. 16/798,234 claims priority to U.S. Provisional Patent Application No. 62/809,491, entitled "FOOTWEAR ARTICLE WITH WEAR GUARD," filed on Feb. 22, 2019. The contents of the above-listed applications are hereby incorporated by reference in their entirety for all purposes.

BACKGROUND/SUMMARY

Footwear articles may undergo substantial stress throughout their use, resulting in degradation of the footwear article over time. Depending on the particular movements of a user utilizing a footwear article, different regions of the footwear article may degrade at different rates. In the context of construction, repair work, and other related fields, for example, users may frequently perform knee-down work, lunging, squatting and other movements which cause frequent flexion at a vamp of a footwear article. Similarly, other activities such as hiking and various sports may also result in frequent flexion at a vamp of a footwear article. Such frequent flexion at a vamp of a footwear article is problematic, as it may lead to rapid degradation at the vamp, particularly where the vamp meets the quarters of the footwear article.

For example, substantial degradation, including formation of a hole, may occur approximately where the vamp and the quarters of the footwear article meet. Thus, degradation is concentrated at the vamp in comparison to a remainder of the footwear article.

Therefore, in view of the above, the inventors have developed a footwear article to at least partially address the above issues. In particular, the inventors have developed a footwear article comprising a flexible vamp wear guard positioned at a vamp of the footwear article. It is noted that the flexible vamp wear guard may also be referred to herein as a wear guard or vamp wear guard herein.

In at least one example, the flexible vamp wear guard may be formed as an overlay over an upper of the footwear article. However, in one or more examples, the flexible vamp wear guard may be integral with the upper of the footwear article. The flexible vamp wear guard may be formed to include bellows, including grooves and ribs, to ensure both structural support and flexibility. Furthermore, the flexible vamp guard may be integrated with a toe cap of the footwear article.

Via the footwear article flexible vamp wear guard as described-above, forces applied to the footwear articled via flexion at the vamp may be dispersed throughout the wear guard, preventing degradation of the footwear article. Furthermore, a flexibility of the flexible vamp guard may ensure that the footwear article is sufficiently flexible for user comfort and mobility.

BRIEF DESCRIPTION OF THE FIGURES

FIGS. 1-35 are drawn approximately to scale. However, other relative dimensions may be used if desired.

DETAILED DESCRIPTION

Figure 1:
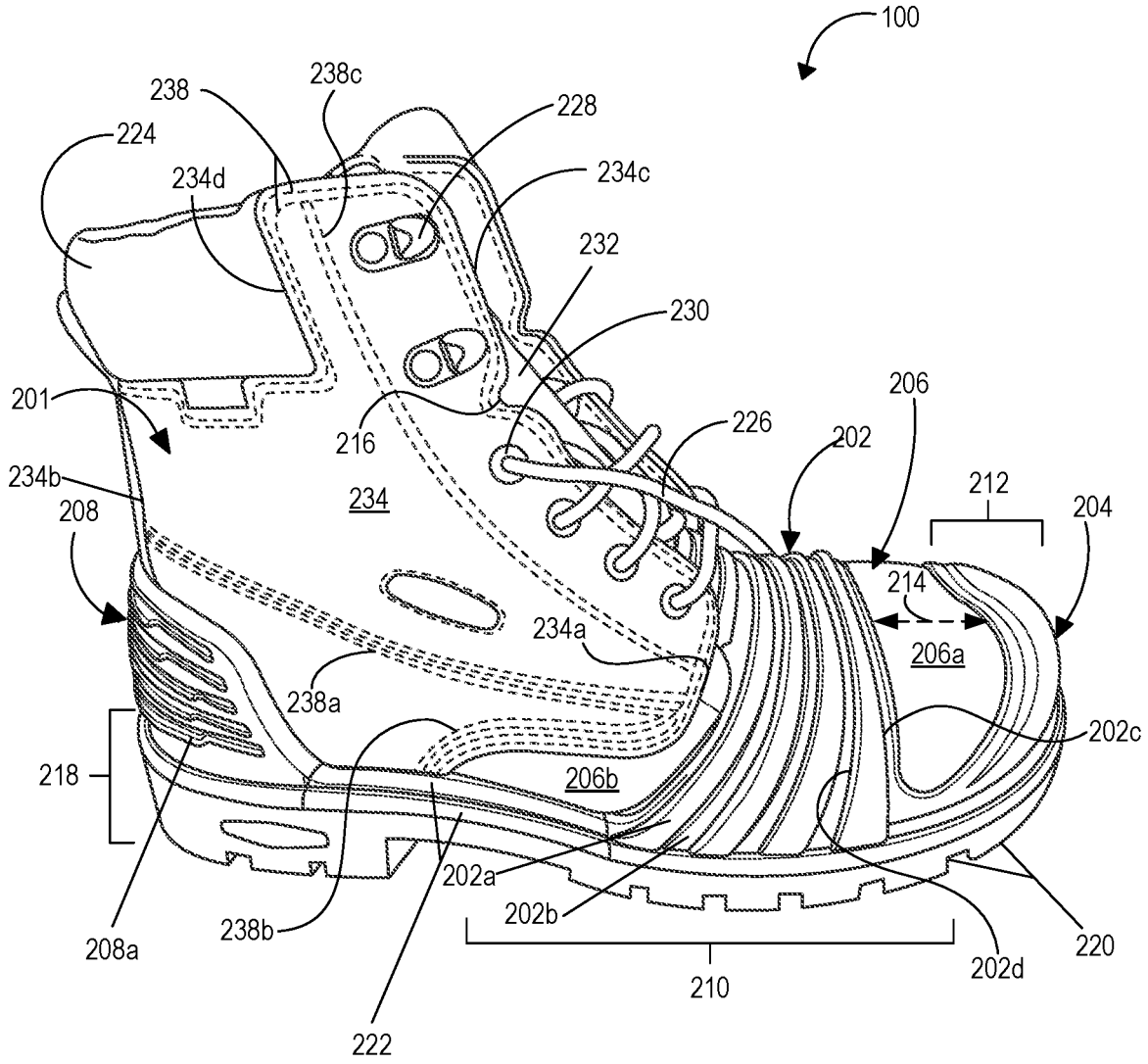
FIG. 1 shows a first side view of a first example footwear article, in accordance with one or more embodiments of the present disclosure.

The following description relates to a footwear article including a wear guard to prevent degradation of an upper of the footwear article while maintaining flexibility and mobility of the footwear article for user comfort.

As shown in FIGS. 1-9 and at FIGS. 11, 14, 20, 24, 27, 30 and 31, the footwear article may comprise a flexible vamp wear guard. The flexible vamp wear guard may be an overlay formed with bellows that include ribs and grooves which provide both force dispersion to prevent degradation of the footwear article while also allowing flexion at the vamp of the footwear article. The bellows may comprise various profiles, such as shown at FIGS. 10A-10F.

Various configurations of the bellows, such as shown at FIGS. 13, 16-19, 22-23, 26, 29, and 33-35 are possible, with various shaping and positioning. In one or more examples, such as shown at FIGS. 1-9 and at FIGS. 12, 15, 21, 25, 28, and 32, the bellows features may be integrated into the heel portion of the footwear article. In this way, flexion may be enabled while avoiding degradation of the footwear article. In one or more representations, the flexible vamp wear guard formed with bellows may be integrated with other wear guard components for improved force dispersion and strengthening of the wear guard. For example, the flexible vamp wear guard may be integrated with one or more of a toe cap, a heel cap, and perimeter wear guard components.

FIGS. 1-35 show the relative positioning of various components of a footwear article. If shown directly contacting each other, or directly coupled, then such components may be referred to as directly contacting or directly coupled, respectively, at least in one example. Similarly, components shown contiguous or adjacent to one another may be contiguous or adjacent to each other, respectively, at least in one example.

As an example, components lying in face-sharing contact with each other may be referred to as in face-sharing contact or physically contacting one another. As another example, elements positioned apart from each other with only a space there-between and no other components may be referred to as such, in at least one example.

As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

Moreover, while various example footwear articles are used to illustrate various features, it is noted that the features across the various footwear articles described herein may be combined. For example, multiple bellows profiles and shapes may be included in the same footwear article. Thus, illustration of one footwear article is not exclusive of features included in other footwear articles illustrated herein. Rather, the features of the various footwear articles are interchangeable and combinable.

For purposes of discussion, FIGS. 2-14 will be described collectively.

FIG. 1 shows a first side view of a first example footwear article 100, in accordance with one or more embodiments of the present disclosure.

In one or more examples, the first example footwear article may be a work boot. However, it is noted that the footwear article 100 is not limited to work boots and that the features of footwear article 100 discussed herein extend to other types of footwear articles. Additionally, the features of other example footwear articles described herein, which may be illustratively shown as work boots, may also extend to other types of footwear articles. These different types of footwear articles may include casual footwear, sandals, various sporting footwear, and other types of boots.

The first example footwear article may comprise a wear guard that is a different material than an upper of the first example footwear article, the upper indicated generally by 201. Upper 201 may include vamp 206 (including toe cap interfacing portion 206*a* and quarter interfacing portion 206*b*), as well as side sections formed by first quarter 234 and second quarter 235. It is noted that the first quarter and the second quarter may also be referred to herein as a first quarter panel and a second quarter panel, respectively. However, in other examples the upper of the footwear article may not include a structure with panels. For example, the upper may instead be a single piece upper or an upper with an alternative paneling arrangement.

In at least one example, the wear guard may comprise any one of natural rubber, vulcanized rubber, ethylene vinyl acetate (EVA), polyvinyl chloride (PVC), polyurethanes such as thermoplastic polyurethane (TPU), and other materials with similar properties. It is noted that any of the guards described herein which include the bellows formation or a grooves only formation may comprise one more of these materials. As to the upper, any of the uppers of the example footwear articles described herein may comprise any one or combination of a moldable material, leather, synthetic leather, knit textiles, nylon, and other materials with similar properties.

The wear guard may be specifically shaped and positioned to protect the upper, while also being sufficiently flexible at vamp 210 to ensure user comfort. In particular, the wear guard may be positioned and shaped so as to comfortably facilitate knee-down movements and other movements causing vamp flexion performed by a user wearing the first example footwear article while reducing material wear and degradation to the first example footwear article.

The wear guard configuration may include one or more components, including one or more of a flexible vamp wear guard 202, a toe cap 204, a heel cap 208, and perimeter 222. It is noted that the flexible vamp wear guard 202 may be formed as an overlay in one or more examples. As such, flexible vamp wear guard 202 may also be referred to as a flexible vamp overlay or a wear guard herein. Furthermore, heel cap 208 may also be referred to as a heel guard herein.

The components of the wear guard configuration may be molded, in at least one example. In some examples, the wear guard configuration may a single molded piece. In other representations, however, components of the wear guard configuration may be molded separately and then joined together.

One or more components of the wear guard configuration may be directly molded to the upper of the footwear article. Additionally or alternatively, one or more components of the wear guard configuration may be formed and then fixed to the upper of the first example footwear article. For example, at least one component of the first example footwear article may be molded and then coupled to the upper via an adhesive. It is appreciated that other attachment means for coupling one or more components of the wear guard to the upper may also be possible, such as stitching or ultrasonic welding.

The flexible vamp wear guard 202, which may be formed with bellows, is positioned at vamp 210 of the footwear article. The vamp 210 may be a region extending between toe 212 of the first example footwear article, and first quarter 234 and second quarter 235 of the first example footwear article (second quarter 235 shown in FIGS. 3 and 4). In particular, vamp 210 is along a lace line of the footwear article, on a toe side of the lace line. The vamp 210 includes a metatarsal phalangeal joint region 101 of the footwear article (see FIG. 2), which is a flexion region of the footwear article immediately adjacent the toe side of the lace line.

The flexible vamp wear guard 202 has a bellows structure, where the bellows structure of the flexible vamp wear guard 202 includes pleating. The pleating of the bellows structure may be formed by ribs 202*a* and grooves 202*b* of the bellows structure, described in further detail below. The pleating of the bellows structure may advantageously enable both expansion and flexion.

The bellows structure of the flexible vamp wear guard 202 may thus enable expansion and bending of the flexible vamp wear guard 202 at a flexion point of a user's foot. In particular, the bellows of the flexible vamp wear guard 202 may be positioned at a metatarsal phalangeal joint region, approximately at a region of a ball of a user's foot, during use. The metatarsal phalangeal joint is a flexion point during knee-down work, lunging, squatting, and other similar movements of a user. Thus, as the flexible vamp wear guard 202 may enable bending at the metatarsal phalangeal joint during use and is shaped to move with a user during use, degradation of the footwear article may be prevented while achieving user comfort.

The metatarsal phalangeal joint region 101 of the footwear article is a region immediately adjacent lacing of the footwear article, on a toe side of the lacing.

Figure 2:
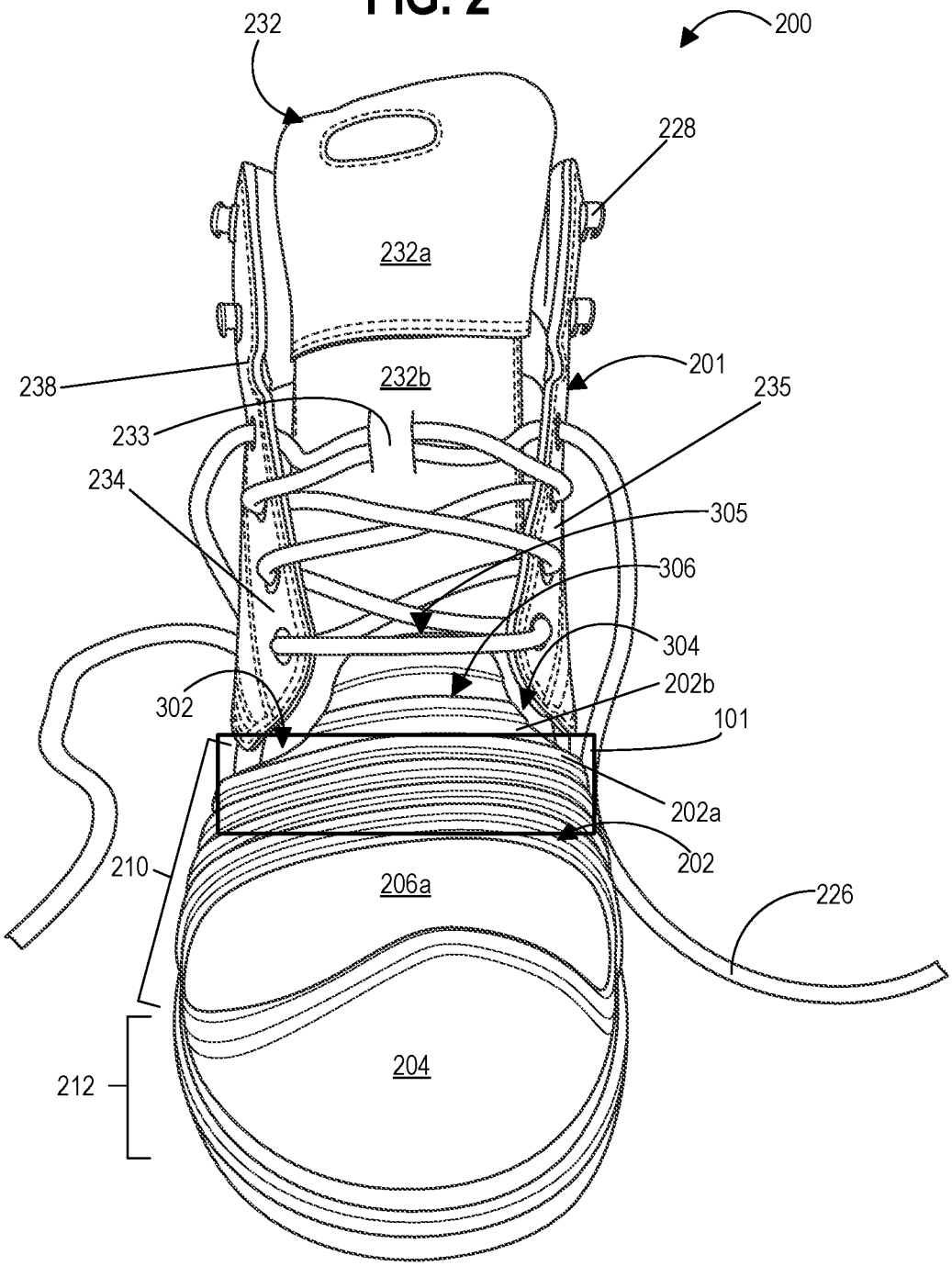
FIG. 2 shows a front view of the first example footwear article, in accordance with one or more embodiments of the present disclosure.

Continuing with the footwear article, in at least one example, the first quarter 234 and the second quarter 235, as shown in FIG. 2, may include structures for retaining laces 226 of the footwear article. For example, the first quarter 234 and the second quarter 235 may include one or more eyelets 230 for receiving laces 226. Further, each of first quarter 234 and second quarter 235 may include a notch 216 to guide laces 238. Additionally or alternatively, first quarter 234 and second quarter 235 may include hooks 228 for receiving laces 226. It is further noted that in at least one example, the footwear article may not comprise laces. Furthermore, the upper of the footwear article may comprise an alternative panel arrangement, straps, or a single piece structure.

First quarter 234 and the second quarter 235 form the sides of the first example footwear article and are a part of upper 201. As shown, the first quarter 234 and the second quarter 235 are panels which extend from an outsole 218 to a tongue 232 of the first example footwear article. Outsole 218 may form a bottom surface of the first example footwear article. The panels (e.g., the first and second quarters 234, 235) may comprise one or more pieces. Stitching 238 may be included to couple pieces of the panels together and/or to provide reinforcement throughout the first quarter 234 and the second quarter 235. Stitching 238 may further be included at the lacing structure, for example.

For example, first quarter 234 may comprise lateral support stitching 238*a*, where the lateral support stitching 238*a* includes stitching from a leading edge 234*a* of first quarter 234 to a heel edge 234*b* of the first quarter 234. The leading edge 234*a* of the first quarter panel is an edge of first quarter panel 234 closest to toe 212 of the first example footwear article. The heel edge 234*b* of the first quarter panel 234 is an edge of first quarter panel 234 closest to a heel of the first example footwear article. In at least one example, lateral support stitching 238*a* may comprises multiple rows of stitches. For example, lateral support stitching 238*a* may comprise three rows of stitches. In examples where the lateral support stitching 238*a* comprises multiple rows of stitches, these rows of stitches may be substantially parallel to one another.

Continuing, first quarter panel 234 may further comprise perimeter stitching 238*b*. Perimeter stitching 238*b* may be stitching that is positioned substantially at an edge of a panel and traces the edge of the panel. For first quarter 234, such perimeter stitching 238*b* may be positioned substantially at one or more edges of first quarter panel 234 and extend along these one or more edges. For example, first quarter 234 may comprise perimeter stitching 238*b* at any one or more of leading edge 234*a*, tongue edge 234*c*, and upper edge 234*d* of first quarter 234. Perimeter stitching 238*b* may include multiple rows of stitches in at least one example. Additionally, in one or more examples, a number of rows for perimeter stitching 238*b* may be varied along the edges of a same panel.

For example, leading edge 234*a* of first quarter 234 may comprise three rows of perimeter stitching 238*b* for approximately a first half of leading edge 234*a*, where the first half of leading edge 234*a* is closer to outsole 218 than a second half of lead edge 234*a*. Leading edge 234*a* of first quarter panel may further comprise two rows of perimeter stitching 238*b* for approximately a second half of leading edge 234*a*, where the second half of leading edge 234*a* is closer to tongue 232 than the first half of leading edge 234*b*. Thus, a same edge of the same panel may have varying rows of perimeter stitching 238*b*.

Such varying rows of perimeter stitching 238*b* at a same edge may be particularly advantageous to vary an amount of support along the same edge. For example, the first half of leading edge 234*a* comprising three rows of perimeter stitching 238*b* may have more support than the second half of leading edge 234*a*, where the second half comprises two rows of perimeter stitching 238*b*.

Additionally or alternatively, it is appreciated that a same number of rows for perimeter stitching 238*b* may be used for an entire edge of a panel. For example, two rows of perimeter stitching 238*b* may be used for a tongue edge 234*c* of first quarter 234. In one or more examples, a number of rows for perimeter stitching 238*b* may be varied from edge to edge for a same panel. For example, a first edge may have two rows of perimeter stitching 238*b* for the entire first edge, and a second edge may have three rows of perimeter stitching 238*b* for the entire second edge. Further still, in one or more representations, a same number of rows of perimeter stitching 238*b* may be used for all edges of a panel. It is noted that in examples where the upper may be a single piece upper, comprise a different paneling arrangement, or have straps, that different perimeter stitching or no perimeter stitching may be used.

Additionally or alternatively to the above stitching structures, first quarter 234 may include lace reinforcement stitching 238*c*. Lace reinforcement stitching 238 may be positioned such that one or more lace receiving structures (hooks 228, eyelets 232, notch 216) are positioned between the lace reinforcement stitching 238*c* and tongue edge 234*c*. Such lace reinforcement stitching 238 may extend a length of first quarter panel 234 from perimeter stitching 238*b* positioned at upper edge 234*d* of first quarter panel 234 to perimeter stitching 238*b* at leading edge 234*a* of the first quarter panel 234. The lace reinforcement stitching 238*c* may help to protect first quarter 234 from degradation due to pulling forces of laces 226. In other examples, however, the footwear article may not comprise laces and thus may not comprise lace reinforcement stitching.

In addition to the above, a tongue 232 may be positioned between the first quarter 234 and the second quarter 235, where the tongue 232 is at least partially overlapped by the first quarter 232 and the second quarter 235. The tongue 232 may include an upper portion 232*a* and a lower portion 232*b*, as described in relation to FIG. 2.

In at least one example, the first quarter 234 and the second quarter 235 may further both be coupled to an ankle support piece 224, where the ankle support piece 224 may be cushioned in one or more examples for user comfort Ankle support piece 224 may further beneficially create a tighter fit to prevent entry of debris, for example.

In one or more examples, the flexible vamp wear guard 202 may be positioned on top of the upper. For example, a vamp portion 206 of the upper 201 may be partially covered by the flexible vamp wear guard 202. Vamp portion 206 may include a toe cap interfacing portion 206*a* and a quarter interfacing portion 206*b*.

The toe cap interfacing portion 206*a* may interface with toe cap 204 and flexible vamp wear guard 202, with the toe cap interfacing portion 206*a* positioned in a gap 214 formed between the toe cap 204 and flexible vamp wear guard 202. The quarter interfacing portion 206*b* may interface with flexible vamp wear guard 202 at the quarters (e.g., first quarter 234 and second quarter 235). However, in one or more examples where the footwear article comprises a single piece upper rather than a paneled structure, flexible vamp wear guard 202 may be positioned at the vamp to prevent degradation at the vamp. Alternatively, in another representation, the flexible vamp overlay 202 may be integrated into the upper rather than on top of the upper 201. The flexible vamp overlay 202 may be formed with bellows and thus include one or more ribs 202*a* and one or more grooves 202*b*, also referred to herein as transverse grooves. The one or more grooves 202*b* are recessed relative to the one or more ribs 202*a*.

The one or more ribs 202*a* and the one or more grooves 202*b* forming the bellows increase a flexibility at the vamp 210 while protecting the upper 201 from degradation. A material of the flexible vamp wear guard 202 may be thinner at the one or more grooves 202*b* of the flexible vamp overlay 202 than the one or more ribs 202*a*, enabling the flexible vamp overlay 202 to bend more easily at the one or more transverse grooves 202*b*. Meanwhile, the ribs 202*a*, which are thicker than the grooves 202*b* of the flexible vamp overlay 202, may help to prevent degradation of the upper 201 by distributing forces created by flexion at the vamp 210.

In at least one example, an end width of each of the ribs 202*a* may be wider at either end of each of the ribs 202*a* compared to a center of each of the ribs 202*a*. Put another way, each of the ribs 202*a* flares out at either end that is adjacent perimeter 222 and/or outsole 218. A center section of each of the ribs 202*a*, where the center section of each of the ribs 202*a* is a portion of the ribs 202*a* that is aligned with and positioned between a lacing structure and toe cap 204 of the footwear article, is thus narrower in width than the ends of the ribs 202*a*. Furthermore, the center section of the ribs 202*a* and the grooves 202*b* are substantially parallel to one another.

By having the width of each of the ribs 202*a* narrower at the center section of each of the ribs 202*a* compared to the ends of the ribs 202*a*, greater flexibility of the flexible vamp overlay 202 may be achieved at the center of the vamp, which is a common flexion region of the footwear article. Thus improved user comfort and mobility may be achieved while still preventing degradation of the footwear article.

In addition to the ribs 202*a* varying in width across a length of the ribs 202*a*, each of the ribs 202*a* may have different curvatures. For example, as shown in FIG. 1, a leading edge 202*c* of the rib 202*a* closest to the toe cap 204 may be substantially perpendicular to perimeter 222 and/or outsole 218. It is noted that the leading edge 202*c* of each rib 202*a* refers to an edge of each rib 202*a* that is closest to the toe of the footwear article. The angle formed between a leading edge 202*c* of each of each rib 202*a* and the perimeter 222 and/or outsole 218 decreases the closer the rib 202*a* is to heel cap 208.

Furthermore, an angle formed between the trailing edge 202*d* of each rib 202*a* and the perimeter 222 and/or outsole 218 of the bellows increases the closer the rib 202*a* is to heel cap 208. It is noted that the trailing edge 202*d* of each rib 202*a* refers to an edge of each rib 202*a* that is closest to the heel of the footwear article.

Such shaping of the ribs 202*a* with the above curvatures may help to ensure bending throughout the flexible vamp overlay 202, so that the flexible vamp overlay 202 bends with a user as the user moves.

In addition to the flexible vamp overlay 202, the wear guard configuration further includes toe cap 204. Toe cap 204 is positioned at a toe of the first example footwear article. In at least one example, toe cap 204 may be positioned on top of overlay 201 of the footwear article. However, in other examples, toe cap 204 may be integral with upper 201 rather than positioned on top of upper 201.

Toe cap 204 is advantageously shaped so as to extend further into the footwear article over a big toe position for a user. Such shaping may beneficially provide additional protection at the big toe position. Toe cap 204 may further beneficially prevent degradation of the footwear article due to scuffing, moisture and debris at the toe 212.

Moreover, toe cap 204 may connect to the flexible vamp guard 202, where the vamp guard is also referred to as a wear guard herein. Thus, the toe cap 204 and the flexible vamp guard 202 may form an integrated structure. That is, the toe cap 204 and the flexible vamp guard 202 be a single, unitary structure. Such integration of the toe cap 204 with the flexible vamp overlay 202 may achieve advantages as to improved support and degradation prevention of the upper 201. While the flexible vamp guard 202 may be formed with bellows, however, it is noted that toe cap 204 may not be formed without bellows.

The first example footwear article further includes a gap 214 (as shown in FIG. 1) between the toe cap 204 and the flexible vamp guard 202. Specifically, gap 214 may be defined by the toe cap 204 and the flexible vamp overlay 202, with an entire perimeter of gap 214 formed by the toe cap 204 and the flexible vamp overlay 202.

Toe cap 204 transitions to the flexible vamp guard 202 at a same location where the toe 212 of the footwear article is indicated to transition to the vamp 210 of the footwear article. Thus, gap 214 may be completely surrounded by the toe cap 204 and the flexible vamp overlay 202. A vamp portion 206 of upper 201 may be positioned within gap 214 and exposed via gap 214. In particular, toe cap interfacing portion 206*a* of the upper 201 may be positioned within gap 214 and exposed via gap 214. Thus, due to gap 214, vamp portion 206 of upper 201 within gap 214 forms part of an external surface of the footwear article. Specifically, toe interfacing portion 206*a* is positioned within gap 214 and forms part of an external surface of the footwear article.

As degradation is typically concentrated at a region of the vamp adjacent quarters of a footwear article, the inclusion of gap 214 may result in a wear guard configuration which strategically protects the upper 201 at locations most susceptible to damage. This strategic approach to protecting the upper may advantageously provide protection against degradation, while avoiding unnecessary overuse of materials.

Moreover, the inclusion of a gap 214 may further be beneficial for reducing an overall weight of the footwear article compared to fully covering the vamp and the toe. Such reduced weight may contribute to overall improved user comfort.

In addition to the toe cap 204, further toe protection may be provided via a toe reinforcement structure. For example, the footwear article may include a toe reinforcement structure underneath the upper 201 at the toe of the footwear article. The toe reinforcement structure may comprise steel, or a composite such as carbon fiber, a dense plastic, or Kevlar, for example. However, in other examples the footwear article may not comprise a toe reinforcement structure.

In one or more examples, the wear guard configuration may further comprise a heel cap 208 positioned at a heel of the first example footwear article. Heel cap 208 may comprise ribs 208*a* for increased structural support. In at least one example, however, heel cap 208 may be more rigid than the flexible vamp wear guard 202. For example, a thickness of heel cap 208 may be greater than a thickness of the flexible vamp wear guard. Thus, although heel cap 208 includes ribs 208*a*, similar to the flexible vamp wear guard 202, it is noted that heel cap 208 does not have the same structuring of the flexible vamp wear guard 202 and heel cap 208 may achieve less flexibility than the flexible vamp wear guard 202.

In at least one representation, heel cap 208 may be positioned on top of upper 201 of the footwear article. However, it is appreciated that heel cap 208 may alternatively be integrated into upper 210.

Heel cap 208 may be connected to the flexible vamp overlay 202 via perimeter 222 of the wear guard configuration. For example, the heel cap 208 may be connected to the flexible vamp overlay 202 via perimeter 222 of the wear guard configuration. Thus, the heel cap 208, flexible vamp overlay 202, and the toe cap 204 may be an integrated structure.

By connecting the heel cap 208, the flexible vamp overlay 202, and the toe cap 204 via perimeter 222, the wear guard configuration may be able to effectively disperse forces to prevent degradation of the upper 201. Moreover, by forming the heel cap 208, the flexible vamp overlay 202, and the toe cap 204 as an integrated structure, improved structural stability of the wear guard configuration itself may be achieved.

In at least one example, the perimeter 222 of the wear guard configuration may be a component that is positioned along an entire perimeter of the footwear article or substantially the entire perimeter of the footwear article. Perimeter 222 of the wear guard configuration may be positioned between the outsole 218 and the upper 201.

In at least one representation, the perimeter 222 of the wear guard configuration may be positioned over a portion of the outsole 218 and a portion of the upper 201. The outsole 218 may include a tread 220, in at least one example. Perimeter 222 may beneficially prevent degradation of the footwear article where the upper 201 and the outsole meet.

Further, in addition to connecting other components of the wear guard configuration to improve force dispersion, and thus prevent degradation of the upper 201, the perimeter 222 of the wear guard configuration may further beneficially improve a coupling of the upper 201 to the outsole 218.

Turning now to FIG. 2, a front view of the first example footwear article 200 is shown. As shown at FIG. 2, tongue 232 includes an upper portion 232*a* and a lower portion 232*b*. The upper portion 232*a* of the tongue 232 may be padded for user comfort and gripping, in at least one example.

The lower portion 232*b* of tongue 232 may include a lace guide 233 for positioning laces 226. Further, the flexible vamp wear guard 202 may include an extension 306 that extends onto lower portion 232*b* of tongue 232. Extension 306 may advantageously help to further disperse forces and prevent degradation of the upper 201. In at least one example, the extension 306 may be rounded to ensure user comfort and to prevent degradation of the upper.

The extension 306 may be positioned between the first quarter 234 and the second quarter 235. In at least one example, extension 306 may be positioned such that extension 306 does not contact the first quarter 234 and the second quarter 235. Extension 306 may further be positioned such that at least a portion of extension 306 is positioned underneath laces 226.

By including extension 306 on lower portion 232*b* of tongue 232 and at least partially underneath laces 226, extension 306 may not only serve to disperse forces to prevent degradation of the upper 201, but also may advantageously provide structural rigidity to prevent wrinkling and degradation of tongue 232. Extension 306 may be formed adjacent the metatarsal phalangeal joint region 101 of the footwear article.

Extension 306 may also be formed with bellows. Thus, extension 306 may also include ribs 202*a* and grooves 202*b*, similar to flexible vamp overlay 202. However, the ribs 202*a* and the grooves 202*b* of the extension 306 bellows may be spaced further apart than a spacing of the ribs 202*a* and the grooves 202*b* along the vamp 210 of the footwear article. That is, a distance between the ribs 202*a* and the grooves 202*b* of the flexible vamp wear guard 202 bellows may be less than a distance between the ribs 202*a* and the grooves 202*b* of the extension 306 bellows.

The further spacing between the ribs 202*a* and the grooves 202*b* at the extension 306 may allow extension 306 to bend in a manner that mimics a user knee-down, lunging, squatting, or other similar position. That is, when a user is in a knee-down position, for example, less flexion is needed at the lower portion 232*b* of tongue 232 than at the vamp 210. Thus, the ribs 202*a* and the grooves 202*b* of the extension 306 bellows are spaced further apart at the lower portion 232*b* of tongue 232 than at the vamp 210 to accommodate such user movement while still providing as much support as possible.

Figure 9:
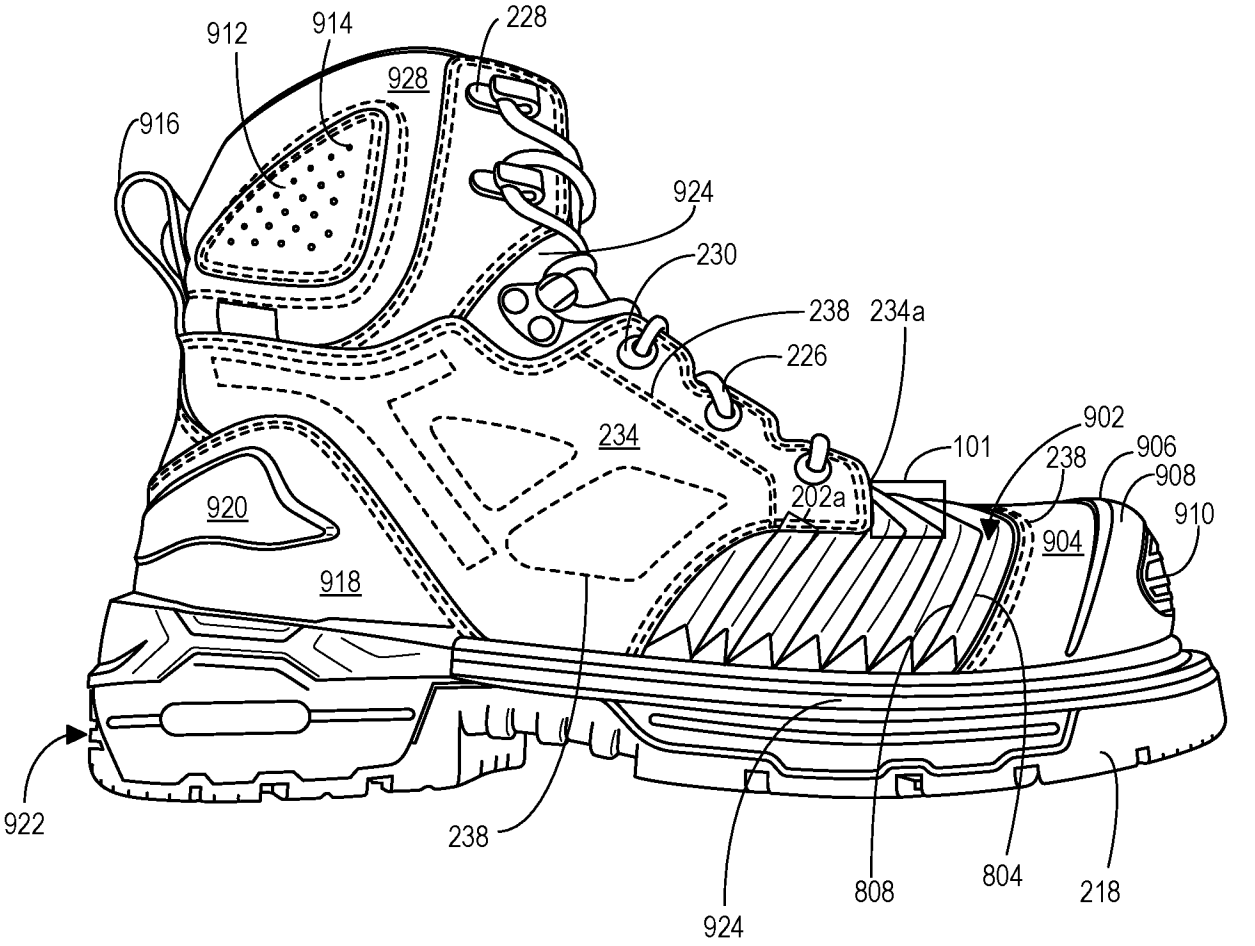
FIG. 9 shows a side view of a fifth example footwear article, in accordance with one or more embodiments of the present disclosure.
Figure 10A:
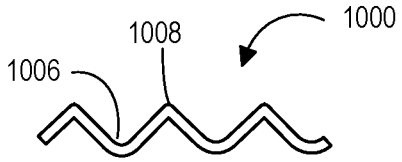
FIGS. 10A-10F show various potential bellows profiles, in accordance with one or more embodiments of the present disclosure.

Looking briefly to FIGS. 10A-10F, it is noted that example profiles for the bellows, such as the bellows of the first example footwear article, are shown. Turning first to FIG. 10A, a first example bellows profile 1000 is shown. As seen at FIG. 10A, there are valleys 1006 and peaks 1008 for the first example bellow profile 1000. The peaks 1008 are relatively pointed, and the valleys 1006 positioned between consecutive peaks 1008 are rounded. A thickness of the material for the first example bellows profile 1000 is substantially constant. Via such a configuration, a durability of the bellows may be achieved while still allowing flexion. While the first example bellows profile 1000 may be used with any one or combination of example bellows discussed herein, it is noted that in at least one example, the bellows profile may be used in conjunction with the example footwear articles at FIGS. 1-9.

Figure 10B:
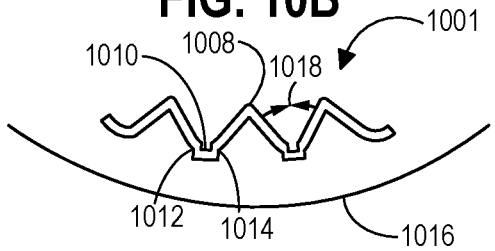

Turning to FIG. 10B, a second example bellows profile 1001 is shown. As seen in FIG. 10B, rather than rounded valleys, the second example bellows profile 1001 instead includes notches 1010. Each of the notches 1010 advantageously include a first living hinge point 1012 and a second living hinge point 1014 so that when peaks 1008 of the second example bellows profile 1001 undergo flexion (as indicated via flexion line 1016), the peaks 1008 of the bellows bed towards each other more easily, as indicated by arrows 1018. It is noted that flexion may occur in a knee-down position, in at least one example. While the second example bellows profile 1001 may be used with any one or combination of example bellows discussed herein, it is noted that in at least one example, the bellows profile may be used in conjunction with the example footwear article at FIGS. 11-13.

Figure 10C:
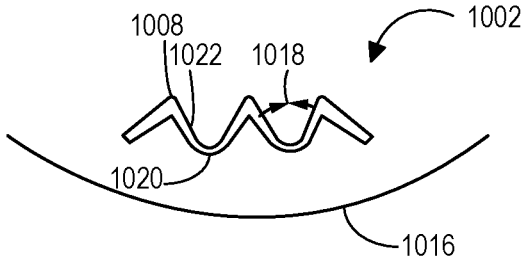

Moving now to FIG. 10C, FIG. 10C shows a third example bellows profile 1002. The third example bellows profile 1002 is also undergoing flexion, as indicated at flexion line 1016. As may be seen at FIG. 10C, the third example bellows profile 1002 includes varied thickness by way of thinned valleys 1020. That is, the thinned valleys 1020 are relatively thin compared to a thickness of the bellows at the peaks 1008 and the walls 1022 extending between the peaks 1008 and the valleys 1020. Moreover, the thinned valleys 1020 are relatively wide in comparison to the second example bellows profile 1001, for example. Via thinned valleys 1020, the bellows are able to easily bend towards one another during flexion, as indicated by arrows 1018. While the third example bellows profile 1002 may be used with any one or combination of example bellows discussed herein, it is noted that in at least one example, the bellows profile may be used in conjunction with the example footwear article at FIGS. 11-13.

Figure 10D:
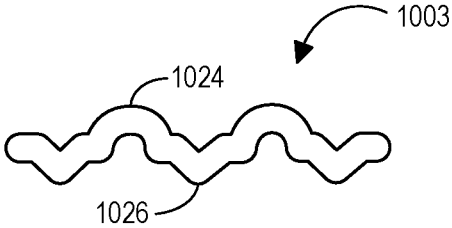

Turning now to FIG. 10D, FIG. 10D shows a fourth example bellows profile 1003. The fourth example bellow profile 1003 forms a raised bars 1024 (also referred to herein as peaks) and capsule shaping to provide flex and structure. The raised bars 1024 are peaks of the fourth example bellows profile 1003, with pointed valleys 1026 formed between consecutive raised bars 1024. When flexed, the valleys 1026 enable movement while the raised bars 1024 provide rigidity and structure. While the fourth example bellows profile 1003 may be used with any one or combination of example bellows discussed herein, it is noted that in at least one example, the bellows profile may be used in conjunction with the example footwear article at FIGS. 24-26.

Figure 10E:
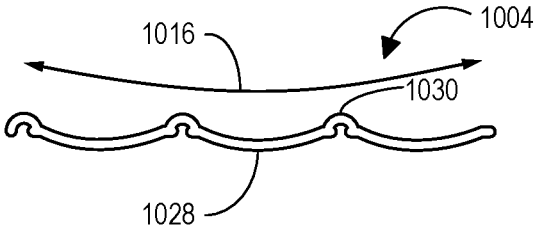

Turning now to FIG. 10E, FIG. 10E shows a fifth example bellows profile 1004. The fourth example bellow profile 1004 includes relatively thin hollow ribs 1030 to form peaks of the profile, and wide valleys 1028. The thin hollow ribs 1030 are approximately c-shaped in cross-section. Such thin hollow ribs 1030 and wide valleys 1028 may be a more flexible bellow profile as compared to the other profiles discussed herein. While the fifth example bellows profile 1004 may be used with any one or combination of example bellows discussed herein, it is noted that in at least one example, the bellows profile may be used in conjunction with the example footwear article at FIGS. 27-29.

Figure 10F:
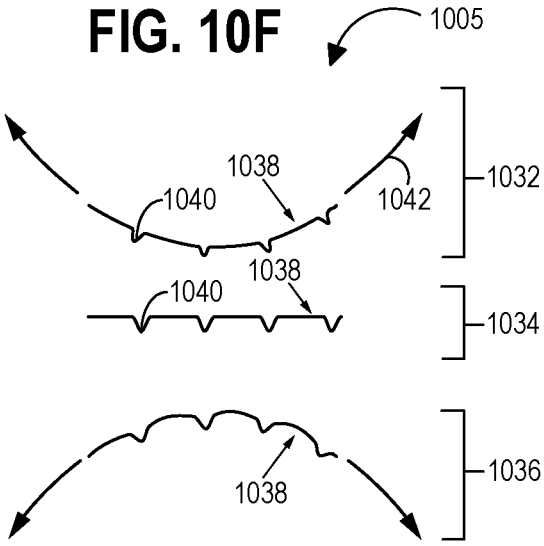

Looking now to FIG. 10F, FIG. 10F shows a sixth example bellows profile 1005 in a flexed position 1032, a flat position 1034 (also referred to herein as a base position), and an expanded position 1036. It is noted that the flexed position 1032 may occur during flexion at the metatarsal phalangeal joint region of the footwear article, such as when walking or during a knee-down position. The flat position 1034 may occur at areas of the footwear article with little curvature. The extended position 1036 may occur when to stretching of the bellows over a user's forefoot is demanded. That is, the expansion may be expansion as the bellows extends from the outsole at an instep of the footwear article the outsole at the outstep of the footwear article. It is noted that the sixth example bellows profile 1005 corresponds to the grid bellows configuration shown at FIGS. 14-19, in at least one example. The sixth example bellows profile 1005 includes quadrilaterals 1038 separated by valleys 1040 to form a grid. In the flexed position 1032, the quadrilaterals 1038 flex towards each other across valleys 1040 and the quadrilaterals flex inward themselves. Due to the quadrilaterals 1038 flexing inward themselves, a top surface of the quadrilaterals curves similarly as the flexion curve 1042. In the flat position 1034, the quadrilaterals 1038 are substantially flat at the top surface. In the extended position 1036, the top surface of the quadrilaterals expands and curves in an opposite direction as during the flexion 1032. This is not least due to void formations of the quadrilaterals 1038, which are discussed in more detail at FIGS. 18-19. Via the ability of quadrilaterals 1038 to curve in a direction of manipulation (collapse under flexion and expand during extension), improved flexibility while maintaining an integrity of the footwear article is achieved. While the sixth example bellows profile 1004 may be used with any one or combination of example bellows discussed herein, it is noted that in at least one example, the bellows profile may be used in conjunction with the example footwear article at FIGS. 14-17. In addition to the example profiles shown, it is noted that further profiles have also been contemplated. For example, profiles where both the peaks and the valleys are substantially V-shaped in cross-section may be possible.

Turning back now to FIG. 1, it is noted that the inclusion of a flexible vamp wear guard 202 including any one or combination of the profiles discussed herein achieves several advantages. For example, by including such a flexible vamp wear guard that covers at least the metatarsal phalangeal joint region (see 101 at FIG. 2) of vamp 210, degradation of the upper 201 at the vamp 210 may be avoided, as forces may be dispersed throughout the wear guard. Moreover, the further inclusion of an extension such as extension 306 from the flexible vamp wear guard 202 onto the lower portion of the tongue 232*b* may help to even further prevent degradation.

Continuing with FIG. 2, as further shown, the flexible vamp overlay 202 may include a first curve 302 along the first quarter 234 and a second curve 304 along the second quarter 235.

The first curve 302 and the second curve 304 may advantageously accommodate the first quarter 234 and the second quarter 235, respectively, to prevent degradation of the first quarter 234 and the second quarter 235 due to friction.

That is, rubbing of the first quarter 234 and the second quarter 235 against the flexible vamp wear guard 202 may lead damage of upper 201 at the first quarter 234 and the second quarter 235. Thus, shaping the flexible overlay 202 to include the first curve 302 and the second curve 304 may help to avoid such degradation, as contact may be minimized or prevented.

As further shown in FIG. 2, the flexible vamp guard 202 is substantially symmetrical. Thus, second curve 304 of the flexible vamp guard 202 substantially mirrors a shape of first curve 302 of the flexible vamp guard 202.

The first curve 302 of the flexible vamp guard 202 continuously curves and transitions to extension 306, including peak 305 of extension 306. Similarly, second curve 304 of the flexible vamp guard 202 also continuously curves and transitions to extension 306, including peak 305 of extension 306. The continuous curved shape of the transition between the flexible vamp guard 202 and extension 306 at first curve 302 and second curve 304 may advantageously improve user comfort while also avoiding degradation to the upper.

Figure 3:
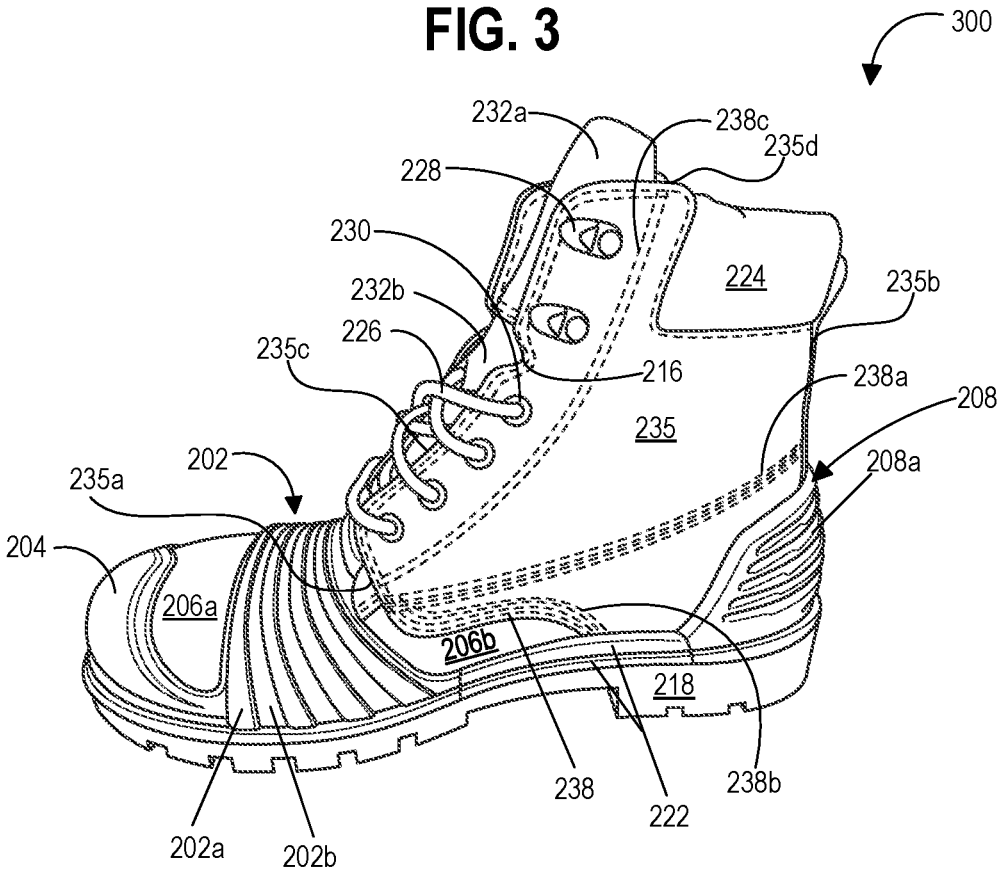
FIG. 3 shows a second side view of the first example footwear article, in accordance with one or more embodiments of the present disclosure.

Turning to FIG. 3, FIG. 3 shows a second side view of the first example footwear article 300. As may be seen in FIG. 3, a shaping of ribs 202*a* and grooves 202*b* of the flexible vamp wear guard 202 are substantially a same shape and sizing on the second side of the first example footwear article as on the first side. Furthermore, second quarter 235 may be more clearly viewed in FIG. 3. It is noted that leading edge 235*a*, heel edge 235*b*, tongue edge 235*c*, and upper edge 235*d* of second quarter 235 correspond to leading edge 234*a*, heel edge 234*b*, tongue edge 234*c*, and upper edge 234*d* of second quarter 234. Details as to the edges, stitching, and the lacing structures of first quarter 234 similarly apply to second quarter 235 and are not further discussed herein.

Referring to FIGS. 1-3, it is clearly seen that wear guard 202 extends from an outsole 218 of the footwear article at a first side of the footwear article to an outsole 218 of the footwear article at a second, opposite side of the footwear article. In particular, the wear guard 202 extends from an instep side of the outsole 218 to an outstep side of the outsole, the wear guard 202 extending across a vamp 210 of the footwear article and the metatarsal phalangeal joint region 101 of the footwear article. The wear guard 202 may be coupled between outsole 218 and the upper of the footwear article, in at least one example. However, in other examples, the wear guard 202 may meet the outsole 218 at a top edge of the outsole 218 without being positioned underneath the outsole 218. In this way, degradation of the footwear article may be avoided while maintaining sufficient flexibility.

Figure 4:
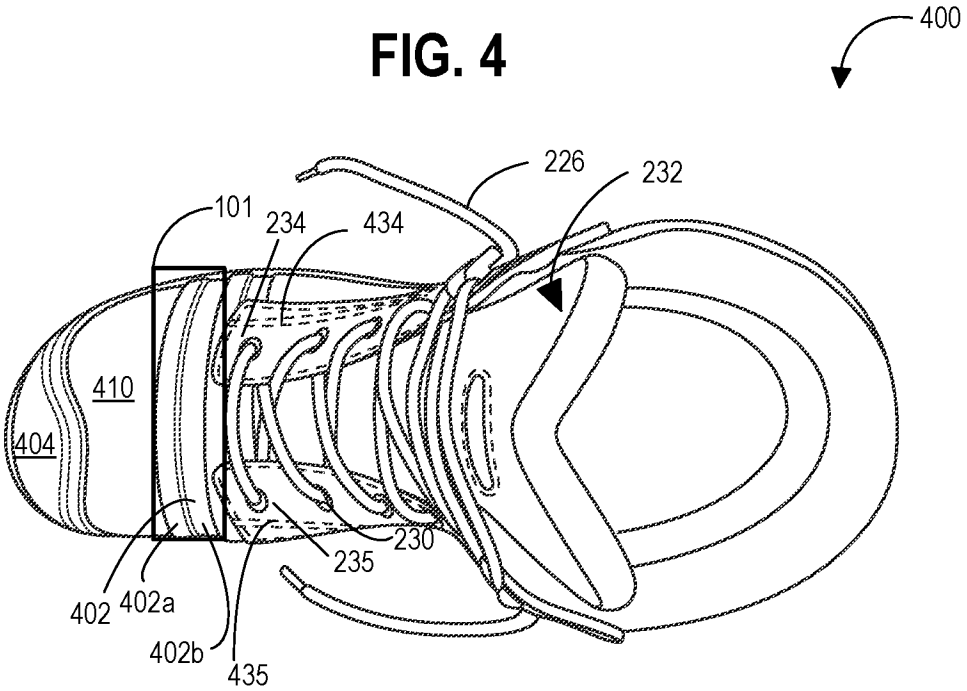
FIG. 4 shows a top view of a second example footwear article, in accordance with one or more embodiments of the present disclosure.

Turning to FIG. 4, FIG. 4 shows a top view of a second example footwear article 400. As may be seen from the top view of the second example footwear article 400, the second example footwear article is substantially similar to the first example footwear article. For example, as in the first example footwear article, the second example footwear article 400 includes a flexible vamp wear guard 402 positioned at a metatarsal phalangeal joint region 101 of the footwear article, which includes similar rib 402*a* and groove 402*b* features as discussed at FIGS. 1-3. Moreover, the flexible vamp wear guard 402 at FIG. 4 extends from the outsole at the first side of the footwear article, across the vamp of the footwear article, to the outsole on the opposite side of the footwear article. However, of notable difference, the flexible vamp overlay 402 of the second example footwear article is partially positioned underneath first quarter 434 and second quarter 435 of the second example footwear article.

That is, rather than the flexible vamp wear guard 402 of the second example footwear article being curved to accommodate first quarter 434 and second quarter 435, the second example footwear article has the flexible vamp wear guard 402 arranged such that first quarter 434 and second quarter 435 are positioned on top of the flexible vamp wear guard 402. Moreover, the flexible vamp wear guard 402 is integrated into the vamp of the footwear article. Similar to the first example, the flexible vamp wear guard 402 is dimensionally smaller than the vamp of the footwear article. Thus, there is a gap 410 between the flexible vamp wear guard 402 and toe cap 404. The flexible vamp wear guard 402 may not be connected to the toe cap 404, in one or more examples. The flexible vamp wear guard 402 extends all the way to the first quarter 434 and the second quarter 435 of the second example footwear article. In particular, the flexible vamp wear guard 402 of the third example footwear article is positioned underneath a portion of a first quarter 234 and second quarter 235.

A heel cap may not be connected to the flexible vamp wear guard 402 or the toe cap 404 in the second example footwear article. In contrast, the heel cap of the first a example footwear articles is integrated with the flexible vamp wear guard and the toe cap.

Further still, the bellows of the second example footwear article extend in a substantially transverse manner underneath the first quarter panel 234 and second quarter panel 235 of the second example footwear article. In contrast the flexible vamp wear guard of the first and second example footwear articles is shaped to curve around the first and second quarters.

Figure 5:
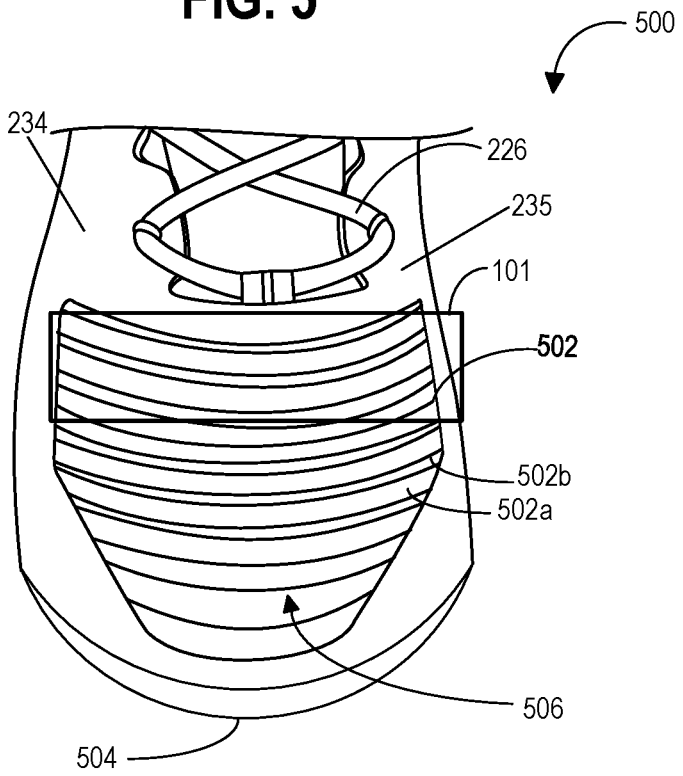
FIG. 5 shows a front partial view of a third example footwear article, in accordance with one or more embodiments of the present disclosure.

Looking to FIG. 5, FIG. 5 shows a front partial view of a third example footwear article 500. In contrast to both the first and the second example footwear articles, the third example footwear article includes a wear guard 502 (also referred to as a flexible vamp wear guard or vamp guard) that is not connected to a toe cap 504 of the third example footwear article. Moreover, the wear guard 502 does not stretch across the footwear article from the outsole on one side to the outsole on the opposite side. Rather, the wear guard 502 is disconnected from the outsole. Wear guard 502 may be integrated into an upper of the third example footwear article, as opposed to being formed as an overlay on top of the upper Similar to the previously discussed footwear article examples, the third example footwear article has the wear guard 502 positioned over the metatarsal phalangeal joint region 101 of the footwear article. The wear guard 502 includes a bellows formation comprising ribs 502*a* and grooves 502*b*, as in the previously discussed wear guard 502. The wear guard 502 further includes an extension portion 506, which extends from the metatarsal phalangeal joint region 101 towards the toe cap 504. Such inclusion of extension portion 506 may advantageously improve dispersion of forces throughout the footwear article and prevent degradation. It is noted that a shape of the wear guard 502 may be varied in at least one example. For example, the wear guard 502 may instead be narrower and form a substantially M-shaped configuration.

Figure 6:
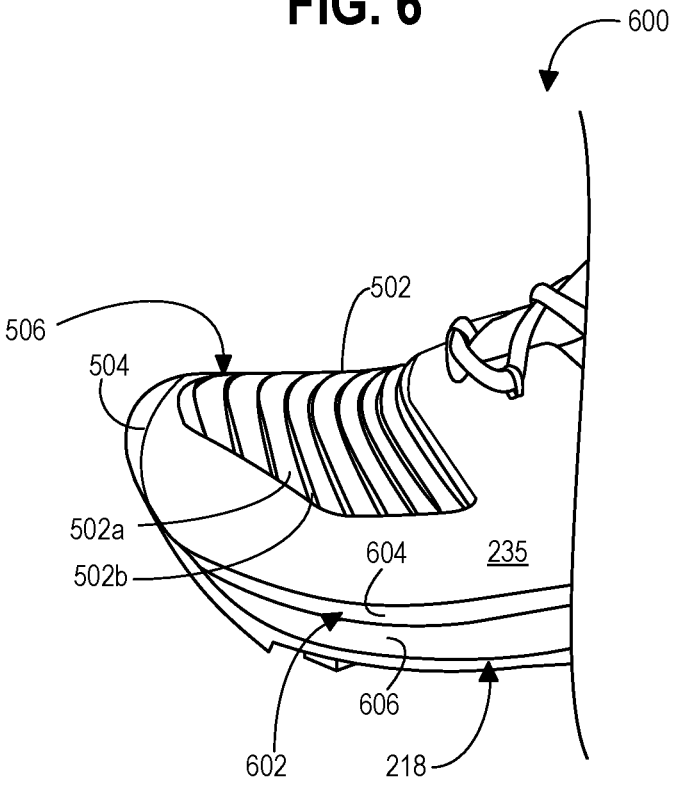
FIG. 6 shows a side partial view of the third example footwear article, in accordance with one or more embodiments of the present disclosure.

Looking briefly to FIG. 6, FIG. 6 shows a partial side view of the third example footwear article 600 at a toe region of the footwear article. As seen in FIG. 6, the wear guard 502 is clearly spaced away from the outsole 218, midsole 602, and from toe cap 504. It is noted that midsole 602 includes a top feature 604 and a middle feature 606, which are further discussed at FIG. 7.

Figure 7:
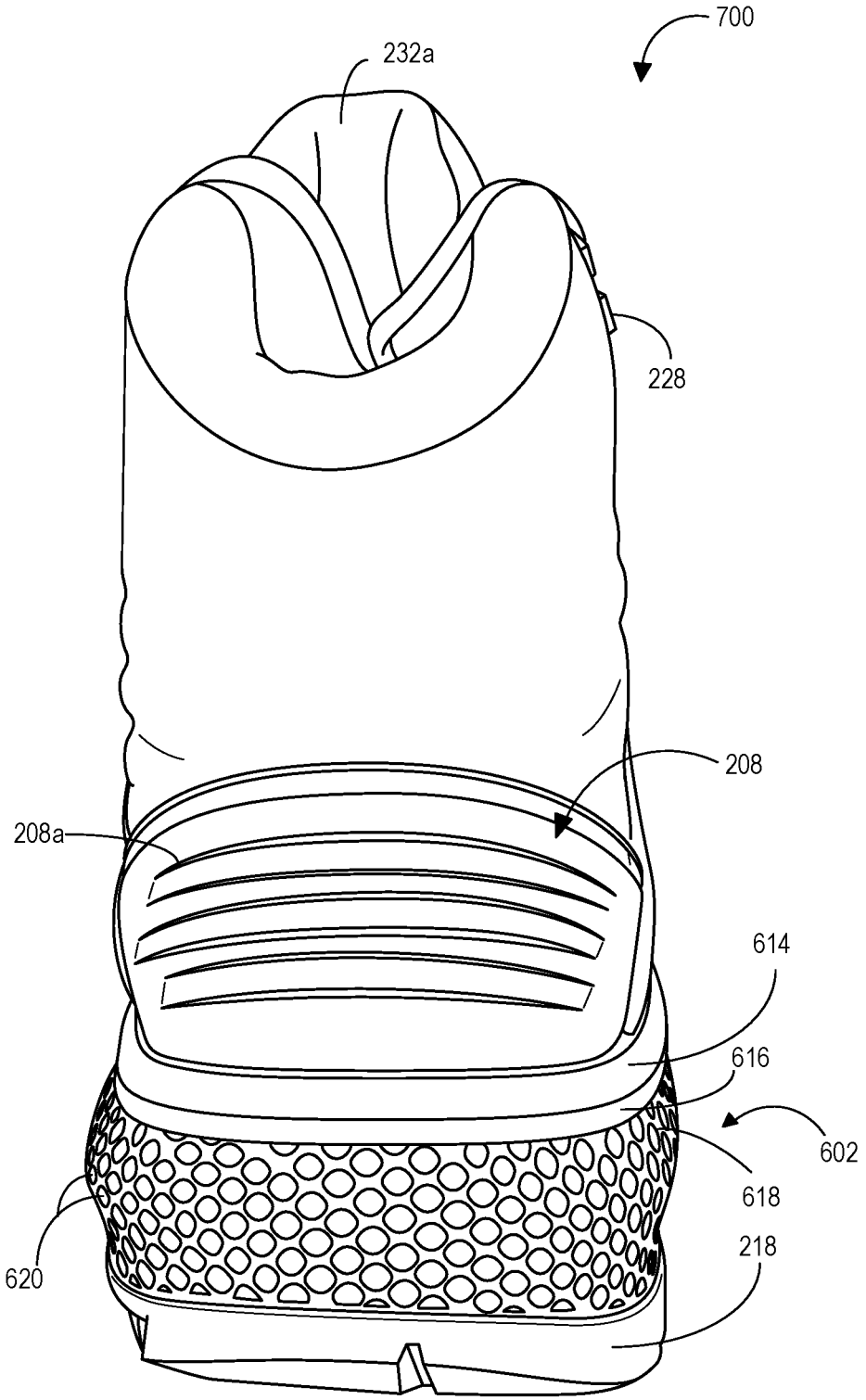
FIG. 7 shows a rear view of the third example footwear article, in accordance with one or more embodiments of the present disclosure.

Turning now to FIG. 7, FIG. 7 shows a rear view of the third example footwear article 700 which shows a heel region of the footwear article. Similar to the previously discussed footwear articles, the third example footwear article includes a heel guard 208 with a plurality of structural ribs 208*a*. These structural ribs 208*a* may advantageously create grip for a user to remove the footwear article, in at least one example. For example, a user may use an opposite foot to push on structural ribs 208*a* or use another surface to create a downward force on structural ribs 208*a* to assist in removing the footwear article.

It is noted that unlike previous examples, the heel guard 208 at FIG. 7 may not be connected to other portions of the overlay. Rather, the heel guard 208 at FIG. 7 is instead a separate piece which may be affixed as an overlay on the heel portion of the footwear article in accordance with any one or combination of the approaches discussed herein. In other words, the heel guard 208 may be adhered, for example, to an outer surface of the footwear article at the heel portion.

In addition to the above, the footwear article of FIG. 7 further includes a midsole 602, the midsole including a top feature 614 and middle feature 616, at the toe region of the footwear article, as discussed at FIG. 6. Moreover, in addition to the top feature 614 and the middle feature 616, the midsole 602 further includes a textured feature 618 at the heel region of the footwear article shown in FIG. 7.

The top feature 614 may be positioned between the middle feature 616 and the upper of the footwear article. The middle feature 616 may be positioned between the top feature and the textured feature 618 of the midsole at the heel region. The textured feature 618 may be positioned between the middle feature 616 of the midsole and the outsole 218 of the footwear article. The textured feature 618 of the midsole includes a plurality of divots 620 which are substantially circular in shape.

Figure 8:
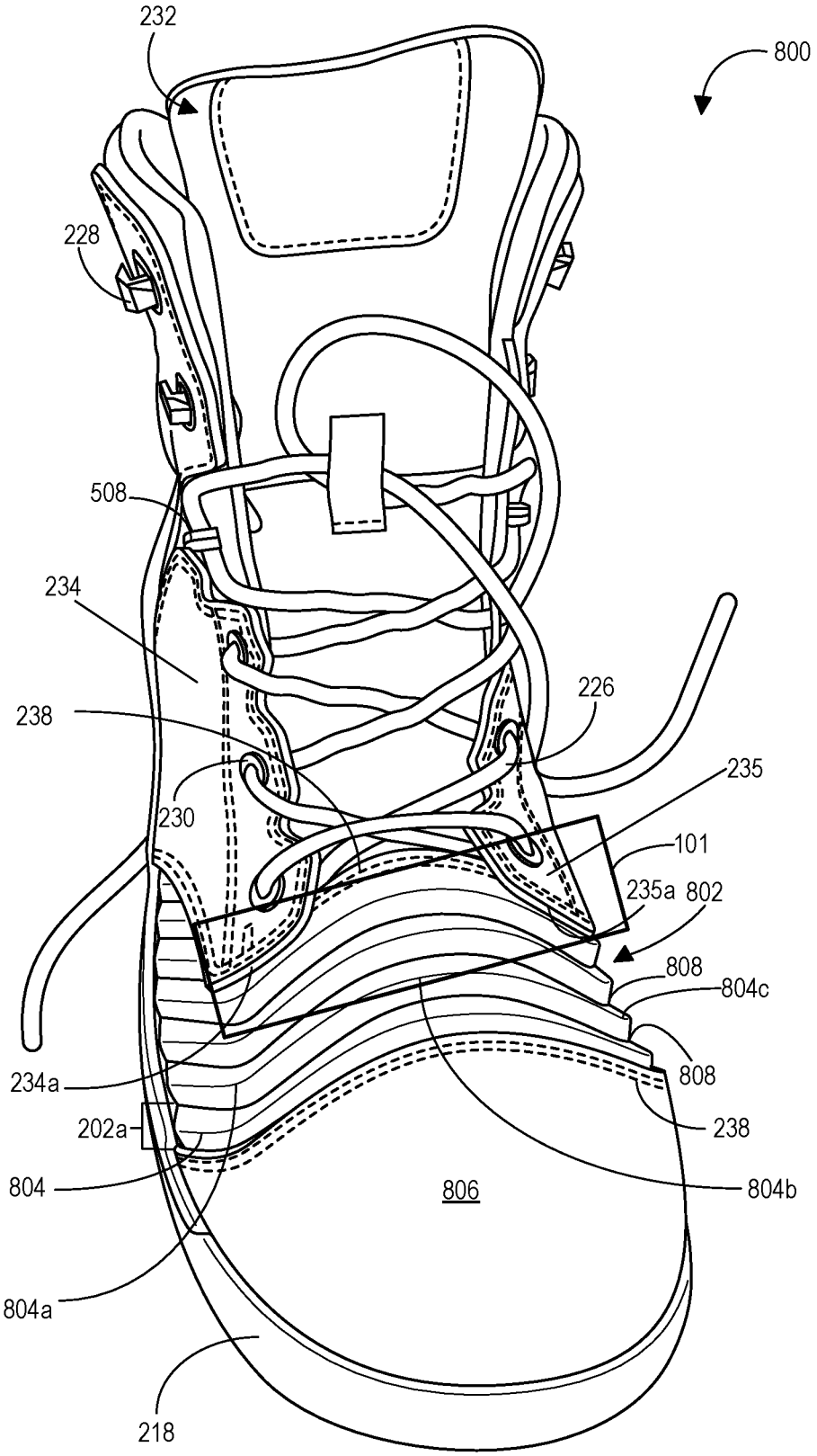
FIG. 8 shows a front view of a fourth example footwear article, in accordance with one or more embodiments of the present disclosure.

Turning to FIG. 8, FIG. 8 shows a front view of a fourth example footwear article 800. It is noted that the wear guard 802 of the fourth example footwear article extends further back towards a heel of the footwear article than in previous examples. Further, the wear guard 802 of the fourth example footwear is positioned between the quarter panels and the outsole of the footwear article. The wear guard 802 extends from a first side of the outsole 218 at an outstep portion of the footwear article, across a vamp of the footwear article (including metatarsal phalangeal join region 101), to a second side of the outsole 218 opposite the first side, at and instep side of the footwear article. The wear guard 802 includes parallel bellows which include parallel ridgelines 804 and valleys 808, the ridgelines 804 and valleys 808 forming multiple curves. In particular, the ridgelines 804 and valleys 808 for the bellows features each include a first curve 804*a* which curves around leading edge 234*a* of the first quarter panel 234 towards a toe of the footwear article. The ridgelines 804 and valleys 808 of the bellows features further each include second curve 804*b* between the first quarter panel 234 and second quarter panel 235, and between the toe of the footwear article and the lacing structure of the footwear article, which curves towards a tongue 232 of the footwear article. The ridgelines 804 and valleys of the bellows features further each include a third curve 804*c*. The first curve 804*a* and the second curve 804*c* may each curve at approximately a location where quarter panels 234, 235 peak in their extension towards a toe of the footwear article. The second curve 804*b* is positioned between the tongue 232 and the toe cap 806 of the footwear article. Such curvature in the ridgelines 804 and valleys 808 advantageously results in bellows which flex in a comfortable manner while still protecting the footwear article from degradation.

The ridgelines 804 of the bellows may correspond to peaks of the bellows profile, such as the peaks discussed at FIGS. 10A-10F, in at least one example. The ridgelines 804 of the bellows may be positioned between two consecutive valleys 808 of the bellows, in at least one example. The valleys 808 of the bellows may correspond to valleys of the bellows profile, such as the valleys discussed at FIGS. 10A-10F, for example.

Turning now to FIG. 9, FIG. 9 shows a side view of a fifth example footwear article 900. As may be seen in FIG. 9, the ridgelines 804 formed by the bellows of wear guard 902 have a bend approximately aligned with the lace guides in the quarter panels. The ridgelines 804 formed by the bellows thus transition from curving towards a tongue of the footwear article to curving around the quarter panels, to extending in a direction that is approximately a 25 degree to a 50 degree angle relative to a direction in which the midsole 924 extends. Though the opposite side is not shown, it is noted that the wear guard 902 extends from an outstep side of the footwear article to an instep side of the footwear article, extending across the metatarsal phalangeal joint region 101. In particular, wear guard 902 meets the midsole 924 at either side of the footwear article. In at least one example, the wear guard 902 may be partially positioned between the midsole 924 and the upper of the footwear article, such that the wear guard is partially underneath the midsole 924.

In the example footwear article shown at FIG. 9, the toe guard comprises a first toe guard panel 904, a second toe guard panel 908, and a ridge 906 positioned between the first toe guard panel 904 and the second toe guard panel 908. In at least one example, the first toe guard panel 904 may comprise a first material, where the first material is a flexible material, such as leather, TPU, etc. The second toe guard panel 908 may comprise a second material, where the second material is less flexible than the first material. The second material may be a rubber or a plastic material in at least on example. Further, the second material may be a textured material, such that the first material is smooth in comparison to the second material in at least one example. In addition to including a ridge 906, the second toe guard panel 908 may further include grips 910. Such a configuration may help to prevent degradation of a toe of the footwear article while still maintaining flexibility.

In addition to the toe guard features, the footwear article at FIG. 9 further includes the quarter panel 234 that may comprise the first material. In at least one example, the quarter panel 234 may further include one or more features formed of stitching 238. Such features may be reinforcing features, in at least one example. At an ankle of the footwear article in FIG. 9, there may be a padded feature 912 in at least one example. The padded feature 912 may include one or more openings 914. Such openings may beneficially allow air to be pushed out of the padded feature 912 upon compression, in at least one example. In addition to the padded feature 912, the footwear article at FIG. 9 further includes a heel tab 916, which may be useful to pull the shoe on, in at least one example. Moreover, regions of the upper may comprise a third material, such as at regions 924 and 928. It is noted that regions 924 and 928 may be a base of the upper, in at least one example, and the quarter panel 934, the wear guard 902, and the toe guard features may all be overlays on top of the base.

The footwear article at FIG. 9 further includes a molded lateral heel panel 918, including a molded guard 920. The molded guard 920 may be positioned at approximately an ankle joint of a user when the footwear article is worn. The molded guard 920 may further wrap around a heel of the footwear article. The molded guard 920 may provide additional lateral rigidity, in at least one example.

As can further be seen, the footwear article at FIG. 9 includes an outsole 218, with various textured features. Such textured features include ribs 922 at a heel of the footwear article. It is noted that the textured features of the outsole 218, such as ribs 922, may advantageously improve grip of the footwear article.

Turning now to FIGS. 11-35, FIGS. 11-35 show various potential bellows configurations. It is noted that one or more of the bellows configurations described at FIGS. 1-10 may be used in combination with any one or more of the bellows configurations at FIGS. 11-35. Or, in at least one example, one or more of the bellows configurations as described at FIGS. 11-35 may be used as alternatives to the examples described at FIGS. 1-10, or one or more of the bellows configurations as described at FIGS. 1-10 may be used without combination with any of the bellows configurations as discussed at FIGS. 11-35. It is noted that combining the bellows configurations may include combining one or more of the profiles, positioning, and curvatures of the bellows features. Furthermore, representations showing bellows configurations such as at FIGS. 13, 16, 22, 26, 29, and 33 may be overlays which are coupled on top of an upper of a footwear article, in at least one example. Or alternatively, representations showing bellows configurations such as at FIGS. 13, 16, 22, 26, 29, and 33 may include the upper itself, and are thus showing how the overlay and upper are already integrated together.

Figure 11:
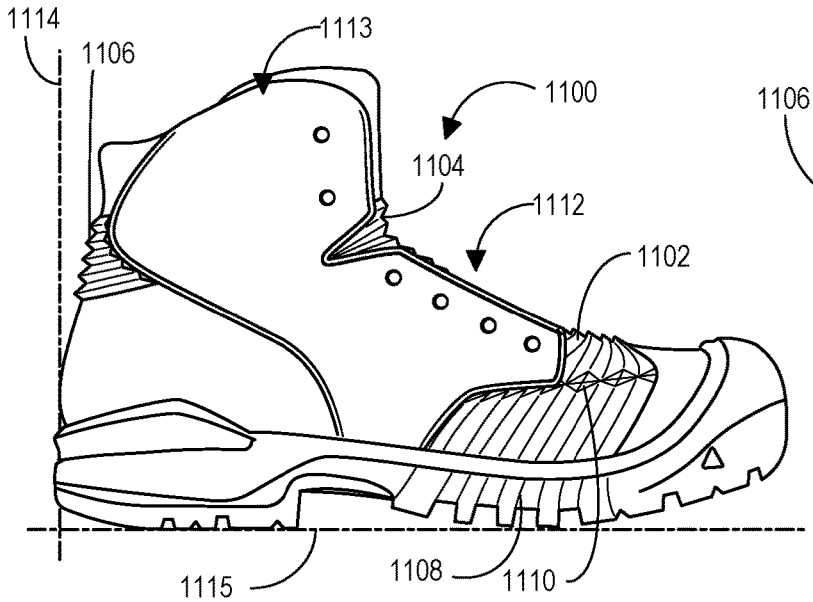
FIG. 11 shows a side view of a sixth example footwear article, in accordance with one or more embodiments of the present disclosure.
Figure 12:
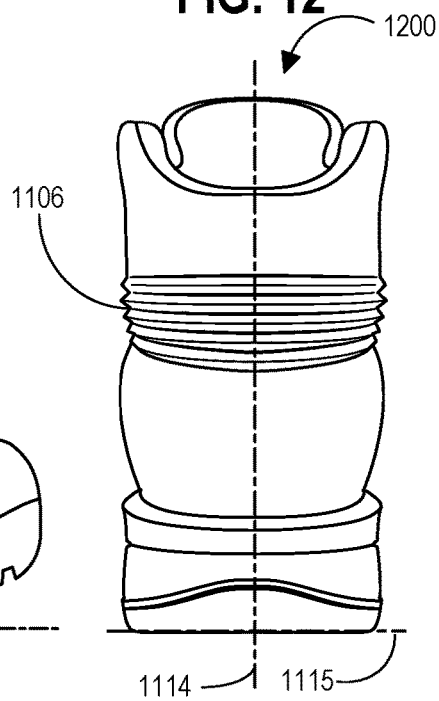
FIG. 12 shows a rear view of the sixth example footwear article, in accordance with one or more embodiments of the present disclosure.
Figure 13:
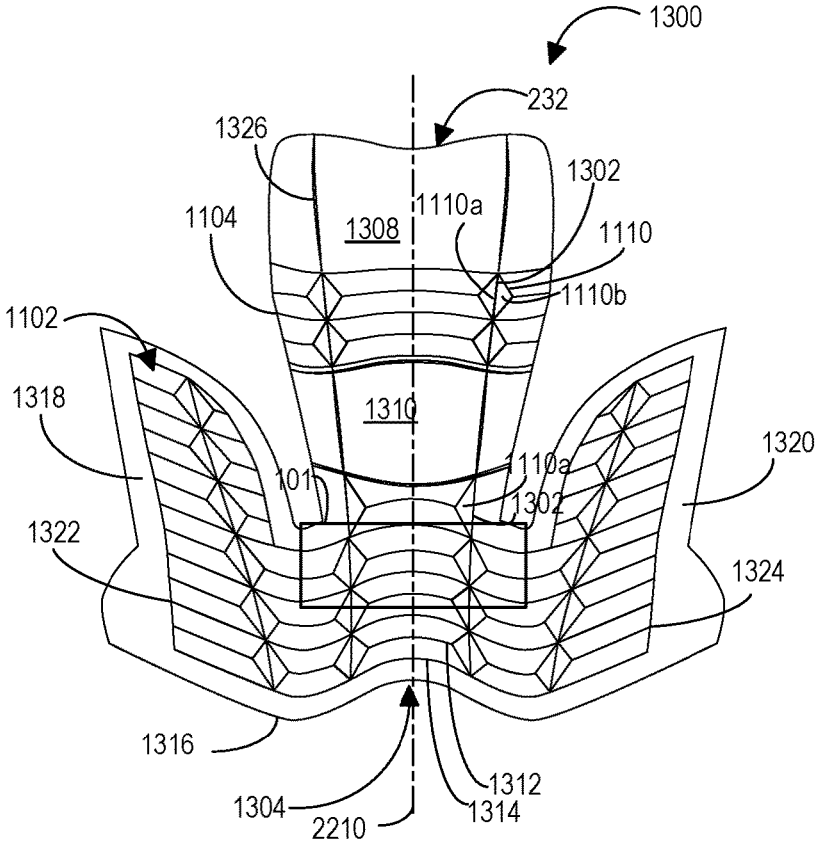
FIG. 13 shows a bellows configuration of the sixth example footwear article, in accordance with one or more embodiments of the present disclosure.

Turning now to FIG. 11, FIG. 11 shows a side view of a sixth example footwear article 1100 between a vertical axis 1114 and a horizontal axis 1115. As may be seen at FIG. 11, wear guards may be positioned at one or more of the vamp (which includes the metatarsal phalangeal joint region 101), an outsole below the vamp, a heel, and a flexion wear guard 1104 which is above a bridge region 1112 of the footwear article. It is noted that second panel 1310, which is described at FIG. 13, is positioned directly over the bridge region 1112. These wear guards include bellows which may have a profile as shown at any one or more of FIGS. 10A, 10B, and 10C, in at least one example. Additionally or alternatively, the bellows profiles as discussed at FIGS. 10D-10F are also possible in the sixth example footwear article.

Wear guard 1102 may be positioned at the vamp, including the metatarsal phalangeal joint region 101. Outsole wear guard 1108 may be positioned at an outsole of the footwear article, below the vamp. Heel wear guard 1106 may be positioned at a heel region of the footwear article. Flexion wear guard 1104 may be positioned adjacent a bridge 1112 of the footwear article. It is noted that the flexion wear guard 1104 may not have a lining. Looking briefly to FIG. 12, which shows a rear view of the sixth example footwear article 1200, the heel guard 1106 comprises a plurality of bellows features which extend across a heel of the footwear article. Further variations to the bellows features shown are possible, in at least one example. For example, while the bellows shown for the heel wear guard 1106 are approximately V-shaped in profile, additional ribbing may be included which is rounded and more narrow in profile. Such additional ribbing may be included in the top portion of the heel wear guard 1106, in at least one example. Further, it is noted that in at least one example, the heel guard 1106 may be stitched to the upper of the footwear article such that the heel guard 1106 is integrated into the heel of the footwear article. For example, a top end of the heel guard 1106 may be stitched on top of the upper and padding positioned underneath the upper. The top end may be a flange, such as a tapered flange, in at least one example. A portion of the heel guard 1106 which includes the bellows formations and which is between the top end and a bottom end, may include a lining. In particular, a lining may be positioned behind the portion of the heel guard 1106 where the bellows are formed.

Furthermore, at the bottom end of the heel guard 1106, an internal counter may be positioned between the heel guard 1106 and the lining. On top of both the heel guard 1106, the internal counter, and the lining may be the upper material which forms an exterior surface of the footwear article. In at least one example, the upper may be stitched directly on top of the bottom end of the heel guard 1106. The bottom end of the heel guard may be a flange, such as a tapered flange, in at least one example.

In at least one example, the heel guard 1106 may be formed with quarter panel wings as a single piece. For example, the heel guard 1106 and the quarter panel wings may be molded as a single piece in any one or combination of the materials discussed herein for wear guards. The single piece heel guard 1106 and quarter panel wings may be symmetrical about longitudinal axis of the heel guard 1106 portion. In such examples, the heel guard 1106 and quarter panel wings may wrap around a top portion of the heel to a rear edge of the quarter panels of the footwear article, as well as wrapping around to a top of the footwear article at a region approximately where the bridge 1112 and the ankle 1113 of the footwear article meet (see FIG. 11). Such an integrated heel guard 1106 quarter panel piece may not extend over the tongue and may be positioned between openings/lace guides of the footwear article. Triangular cutouts may be included in the quarter panel wings at lateral positions of the footwear article. Moreover, the single piece heel guard 1106 and quarter panel wings may leave substantially all of a bottom of the heel of the footwear article on the rear and sides uncovered, as well as a sides of the upper ankle portion uncovered. Such a single piece heel guard 1106 and quarter panel wings may include tapered lasting flanges at the edges for coupling to the footwear article Minimal lining, such as foam lining, may be included underneath the single piece heel guard 1106 and quarter panel wings. A remainder of a collar of the ankle 1113 (see FIG. 11) may be padded with foam. For example, no foam may be included on the inside surface of the footwear article where the single piece heel guard 1106 and quarter panel wings are positioned. Rather, only lining may be included on the inside surface of the footwear article where the single piece heel guard 1106 and quarter panel wings are positioned. The single piece heel guard 1106 and quarter panel wings may be stitched to the ankle 1113 (see FIG. 11) of the footwear article, in at least one example. For example, stitching along two side edges of the heel guard 1106 may be included. The stitching may be visible on the outside and inside of the footwear article, in at least one example.

In addition to the bellows features, the wear guard 1102 may further include one or more inflection features 1110. These inflection features 1110 may be approximately diamond shaped. For example, looking to FIG. 13, FIG. 13 shows an example bellows configuration of the sixth example footwear article 1300, in accordance with one or more embodiments of the present disclosure. It is noted that reference to bellows configurations, such as the shown at FIGS. 13, 16, 22, 29, and 33, refers to bellows pieces that may be integrated into a footwear article. That is, the bellows configurations at FIGS. 13, 16, 22, 29, and 33 show a bellows piece that may be integrated into a footwear article by way of one or more of adhesives, stitching, sonic welding, and direct molding. As may be seen at FIG. 13, the inflection features 1110 comprise two adjacent panels 1110*a*, 1110*b* meet along crease 1302. These adjacent panels 1110*a*, 1110*b* may each be triangular and form a diamond shaped inflection feature together.

Each of the two adjacent triangle panels 1110*a*, 1110*b* are angle downward, away from a top surface of the footwear article, to meet at crease 1302. Inflection features 1110 allow flexion at crease 1302, and the shape of the inflection features 110 helps to prevent unwanted deformation of other portions of the bellows when bending occurs at the inflection features 1110. The inclusion of such inflection features 1110 advantageously improves a flexibility of the footwear article. In particular, inflection features 1110 may be strategically positioned throughout the footwear article to provide localized flexibility where needed. For example, the inflection features 1110 may be positioned substantially end to end across a length of the wing 318 and across a length of the wing 1320 with associated creases 1302 aligned end to end. Via such positioning of the inflection features 1110 in the first wing 1318, increased flexibility may be introduced specifically where the inflection features 1110 are positioned. The second wing 1320 may also include a similar configuration as the first wing 1318.

Though the arrangement of inflection features 1110 shown at FIG. 13 is one possibility, it is noted that other arrangements of the inflection features 1110 may be possible without departing from the scope of the present disclosure. For example, in at least one example, there may be more or fewer inflection features included in flexion guard 1104. For example, there may be three inflection features 1110 aligned end to end at the flexion guard 1104, rather than only two inflection features 1110. Similar modifications may be made to the arrangement of inflection features 1110 in one or more of the medial panel 1304, the first wing 1318, and the second wing 1320. Additionally or alternatively, the inflection features 1110 may be at different positions throughout the bellows configuration 1300, in at least one example.

In at least one example, stitch lines 1326 may extend onto the first panel 1308 and second panel 1310 of tongue 232 in alignment with creases 1302 of the inflection features 1110 formed into the flexion guard 1104. Moreover, it is noted that the flexion guard 1104 may be stitched to the first panel 1308 and the second panel 1310 in at least one example. For example, a flange (such as a tapered flange) at a first end of the flexion guard 1104 may be positioned between an outer layer of the first panel 1308 and foam lining the back of the first panel 1308. Similarly, a flange at a second opposite end of the flexion guard 1104 may be positioned between an outer layer of the second panel 1310 and foam lining the back of the second panel 1310.

As to wear guard 1102, wear guard 1102 may also be coupled to second panel 1310 via stitching. In at least one example, the wear guard may be stitched on top of the second panel 1310. Further, in one or more examples, the end of the wear guard 1102 stitched on top of the second panel 1310 may not be tapered and an opposite end of the wear guard 1102 may include a tapered flange.

Looking to first wing 1318 and second wing 1320, it is noted that the outer edge of the bellows 1322 at the first wing 1318 and the outer edge of the bellows 1324 at the second wing 1320 may be shaped to match a topline of a midsole or outsole of the footwear article to which the bellows configuration 1300 is being coupled. In particular, some footwear articles do not include a midsole. Thus, in such examples, the outer edges 1322, 1324 may be shaped to match the outsole of the footwear article. However, in cases where the footwear article includes a midsole, the outer edges 1322, 1324 may be shaped to match the midsole. By matching the shaping of the outer edges 1322, 1324 to match the outsole or midsole, it is meant that a curvature of the outer edges 1322, 1324 is shaped fit along the midsole or outsole in an aligned manner without gaps. Such an example where the bellows outer edge matches the midsole of a footwear article may be seen at wear guard 1102 of FIG. 11. In this way, the bellows in the bellows configuration may be able to extend from an outsole at a first side of the footwear article to the outsole at an opposite side of the footwear article.

In at least one example, it is noted that one or more of the wear guard 1102, flexion guard 1104, and heel guard 1106 may include tapered edges or flanges, such as lasting flanges, to enable easier coupling with the footwear article.

Turning to tongue 232, tongue 232 includes a first panel 1308, flexion wear guard 1104, and a second panel 1310.

The first panel 1308 and the second panel 1310 may comprise a first material that is different than a second material of the flexion wear guard. For example, the first panel 1308 and the second panel 1310 may comprise leather, while the flexion wear guard 1104 may comprise a plastic, such as TPU, or a rubber material. The bellows formed into the tongue 232 include a slight curve towards a top of the tongue 232 along a medial center of the entire bellows configuration. The tongue 232 may include two sets of aligned inflection features 1110, which are symmetrical about the medial center of the bellows configuration. It is noted that the entire bellows configuration, including ridges 1312, valleys 1314, and inflection features 1110, is symmetrical about the medial center of the bellows configuration 1300. Moreover, it is noted that reference to ridges of the bellows herein, such as ridges 1312, are understood to correspond to peaks illustrated at FIGS. 10A-10F and may follow any one or combination of the profiles as discussed at FIGS. 10A-10F. Similarly, reference to valleys of the bellows herein, such as valleys 1314, are understood to correspond to the valleys illustrated at FIGS. 10A-10F and may follow any one or combination of the profiles as discussed at FIGS. 10A-10F.

Turning to medial panel 1304, which is positioned between the first wing 1318 and second wing 1320, and below tongue 232, further inflection features 1110 are positioned therein. These inflection features, similarly to the inflection features 1110 of the first and second wings 1318, 1320, are positioned end to end with associated creases 1302 aligned end to end.

In one or more examples, the bellows configuration may be formed in a single piece for first wing 1318, second wing 1320, medial panel 1304, and tongue 232. It is noted that the first wing 1318 and the second wing 1320 may also be referred to herein as wings, in at least one example.

Alternatively, in at least one example, the wings 1318, 1320 and medial panel 1304 may be formed as a single vamp piece, the flexion wear guard 1104 that is positioned on tongue 232 may be formed as a separate tongue piece, and the heel guard 1106 may be formed as yet another separate piece. It is further noted that while the heel guard 1106 may have variations in shape. For example, the heel guard 1106 may be formed into a substantially hourglass shape as an alternative shape variation. As to the tongue 232, is noted that portions of the tongue which do not include flexion guard 1104 may be padded. That is, one or both of first panel 1308 and second panel 1310 may be padded. In some examples, such padding at the first panel 1308 and/or second panel 1310 may include a leather covering. The flexion guard 1104 may be sewn to the first panel 1308 and the second panel 1310 such that the flexion guard is integrated into the tongue 232 direction, as opposed to placed on top of the tongue 232. Moreover, in at least one example, there may be material joining wings 1318, 1320 and tongue 232. In particular, material may be included to joint an edge of the wings 1318, 1320 that is opposite toe edge 1316 of the bellows configuration 1300 to the outer edges of the tongue 232 closes to the wings 1318, 1320. Such inclusion of a material may help to maintain proper positioning of the bellows configuration on the footwear article. Further, in addition to the bellows formations shown, it is noted that additional bellows in the form of ribs and grooves may be included at a throat of the bellows configuration shown in FIG. 13, between the tongue 232 and medial panel 1304. Furthermore, in at least one example, the bellows configuration shown at FIG. 13 may further include openings formed therein for attachment purposes to the footwear article.

Between inflection features 1110 of the medial panel 1304 and inflection features 1110 of the wings 1318, 1320, it is noted that the ridges 1312 and valleys 1314 of the bellows curve towards a toe edge 1316 of the bellows configuration 1300. In contrast, between the inflection features 1110 of the first side of the medial panel 1304 and the inflection features of the second side of the medial panel 1304, the ridges 1312 and valleys 1314 of the bellows curve towards a tongue of the bellows configuration 1300. Such curvature may improve a movement of the bellows with the user when the footwear article is in use. Moreover, the curvature of the ridges 1312 and valleys 1314 of bellows shown in FIG. 13 further achieves advantages as to improved user comfort by helping to prevent the wear guard from digging into a user's foot during use. In at least one example, the features of the bellows configuration at FIG. 13 are symmetrical about medial axis 2210.

Figure 14:
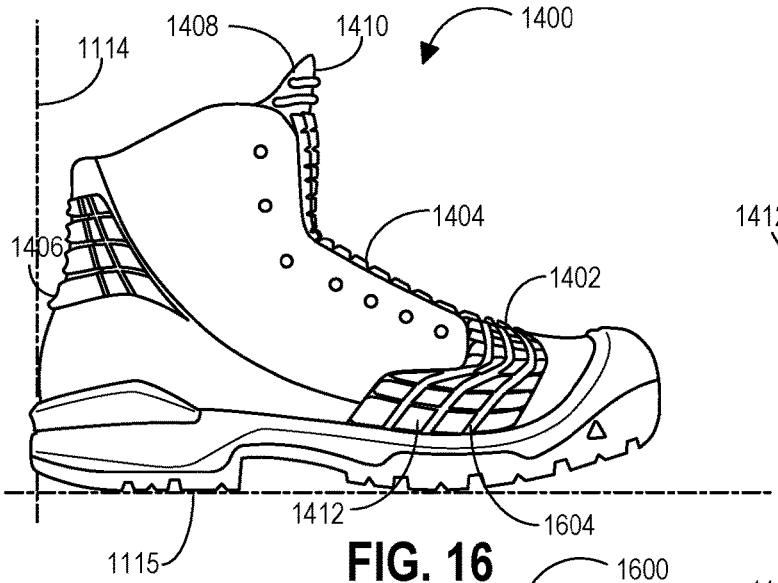
FIG. 14 shows a side view of a seventh example footwear article, in accordance with one or more embodiments of the present disclosure.
Figure 15:
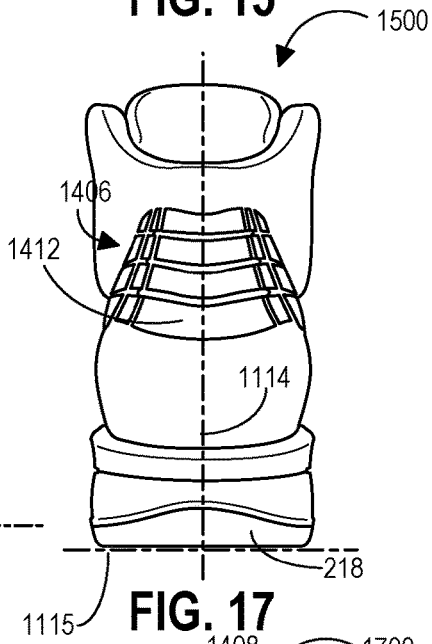
FIG. 15 shows a rear view of the seventh example footwear article, in accordance with one or more embodiments of the present disclosure.

Turning now to FIG. 14, FIG. 14 shows a side view of a seventh example footwear article 1400, according to one or more examples of the present disclosure. As may be seen in FIG. 14, the footwear article includes a wear guard 1402 that may be positioned at the vamp, including the metatarsal phalangeal joint region 101. The footwear article may further include one or more of a flexion wear guard 1404 positioned on the tongue of the footwear article and a heel wear guard 1406 positioned at a heel region of the footwear article. Looking briefly to FIG. 15, which shows a rear view of the seventh example footwear article 1500, the heel guard 1406 comprises a plurality of bellows features in a grid formation, where the grid comprises a plurality of quadrilaterals 1412 which extend across a heel of the footwear article. The grid includes a curvature towards the outsole 218 of the footwear article. In at least one example, it is noted that heel guard 1406 may further include one or more rib formations which follow a similar curvature as the grid. A rounded extension to accommodate these additional rib formation at a top of the heel guard 1406 may also be included. Moreover, it is noted that a shaping of the heel guard 1406 may be varied in at least one example. For example, the heel guard 1406 may be substantially triangular in shape with rounded flanges at each point of the triangle. One or more of the rounded flanges may be tapered in at least one example. It is noted that the edges of the heel guard 1406 may be stitched to the footwear article in at least one example. For example, a top end of the heel guard 1406 may include a flange which is stitched to a top of the footwear article, including on top of the upper and foam padding of the footwear article. A bottom end of the heel guard 1406 may include a flange (such as a tapered flange) which is stitched between the upper and an internal counter of the footwear article. A lining may be positioned directly behind the grid of the heel guard 1406, in at least one example. In at least one example, a portion or all edges of the heel guard 1406 may be tapered, to form a tapered flange which borders the entire heel guard 1406.

Figure 17:
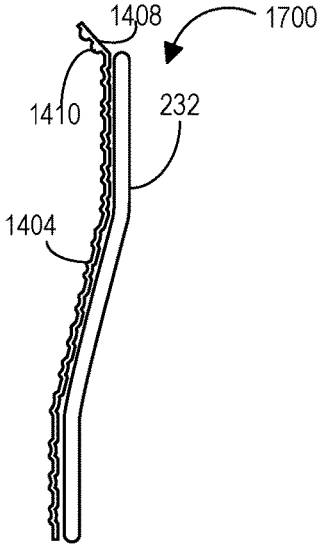
FIG. 17 shows a profile view of the bellows configuration of the seventh example footwear article, in accordance with one or more embodiments of the present disclosure.

As further illustrated at FIG. 14, the footwear article may further include a pull tab 1408 which extends at a top of a tongue of the footwear article. Looking briefly to FIG. 17, which shows a profile view of the bellows configuration of the seventh example footwear article, it can be seen that the pull tab 1408 is an extension of the flexion wear guard 1404. In particular, as seen in FIG. 17, the flexion wear guard 1404 is positioned on top of and coupled to tongue 232. Pull tab 1408 extends from the flexion wear guard 1404 to above tongue 232, such that the pull tab 1408 is not coupled directly to the tongue 232. Rather, pull tab 1408 is coupled indirectly to tongue 232 via flexion wear guard 1404. The pull tab 1408 further includes one or more ridges 1410 which can make it easier to grip pull tab 1408. The pull tab 1408 feature may advantageously enable a user to maneuver tongue 232. In at least one example, pull tab 1408 may comprise TPU and/or rubber material. Furthermore, the ridges 1410 of pull tab 1408 may include tapered edges in at least one example.

Figure 16:
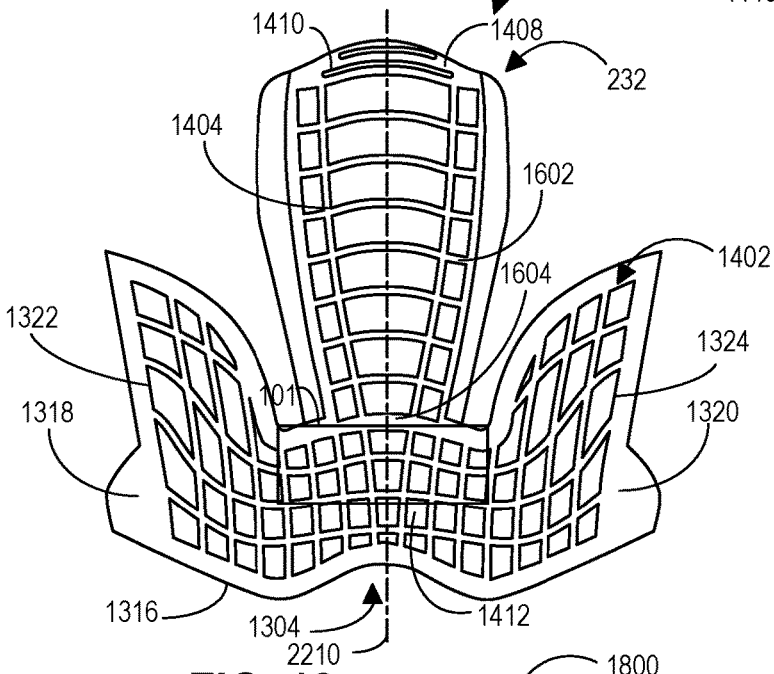
FIG. 16 shows a bellows configuration of the seventh example footwear article, in accordance with one or more embodiments of the present disclosure.

Looking now to FIG. 16, FIG. 16 shows a bellows configuration of the seventh example footwear article 1600. As may be seen in FIG. 16, the bellows configuration is a grid configuration comprising a plurality of quadrilaterals 1412. The wings 1318, 1320, medial panel 1304, and tongue 232 of the bellows configuration may be formed as a single piece, in at least one example, and the heel guard 1406 may be formed as a separate piece. The quadrilaterals 1412 of the grid may vary in size. Each quadrilateral 1412 of the grid may be molded to include a similar top surface shaping, as discussed in further detail below. Further, the grid may be symmetrical about a medial axis 2210 of the bellows configuration 1600. In at least one example, a height of the quadrilaterals 1412 may be varied within the grid. For example, the quadrilaterals 1412 positioned along the medial panel 1304 may be shorter than the quadrilaterals 1412 positioned on wings 1318, 1320. In at least one example, the junction where the wings 1318, 1320 meets the medial panel 1304 may have a height change, where the medial panel 1304 quadrilaterals 1412 are shorter than the wing 1318, 1320 quadrilaterals 1412 at the junction. Similarly to the example at FIG. 13, the outer edges 1318, 1320 of the grid formed by the quadrilaterals 1412 may be curved to match a shape of a top line of a midsole. Or, in examples where there may not be a midsole, the outer edges 1318, 1320 of the grid formed by the quadrilaterals 1412 may be curved to match a top line of the outsole. In this way, the outer edges 1318, 1320 may positioned adjacent the midsole or outsole in an aligned manner without gaps.

In at least one example, the tongue 232 portion of the bellows grid may be attached to the tongue of a footwear article via a material which wraps around from a back of the tongue to on top of the tongue 232 portion of the bellows grid. This material may be stitched on top of the tongue 232 portion at an edge of the bellows grid. The material is not stitched on top of the quadrilaterals 1412. Foam may be positioned between the material and the bellows grid for padding, in at least one example. Such a flange may be wrapped around the tongue of the footwear article, including The inclusion of a grid bellows configuration as shown may advantageously improve flexion in every position. For example, whereas other bellows configurations discussed herein may be suited for flexion across the forefoot from the medial to lateral sides, the grid configuration may enable flexion with a user in any position. It is further noted that the quadrilaterals 1412 of the grid are separated by valleys 1602 (also referred to herein as voids). The inclusion of such valleys 1602 enables flexion in combination with the formation of each of the quadrilaterals 1412 to flex in both flexed and extended positions. The quadrilaterals 1412 may correspond to the quadrilaterals at FIG. 10F, and the valleys 1602 may correspond to the valleys at FIG. 10F, in at least one example. It is noted that there is specifically a valley 1604 (which may also be referred to herein as a void) at throat 1604 between the tongue 232 and the medial panel 1304 in order to ensure that the wear guard flexes at the base of the throat.

Figure 18:
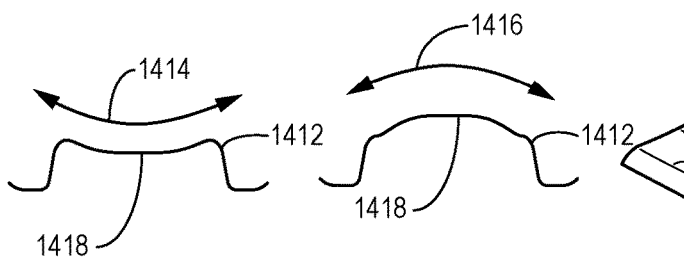
FIG. 18 shows a schematic representation of bellows features of the seventh example footwear article, in accordance with one or more embodiments of the present disclosure.
Figure 19:
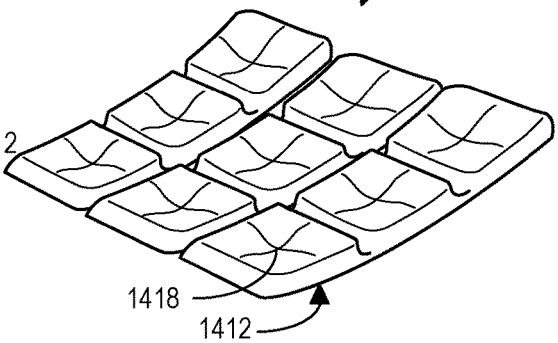
FIG. 19 shows a schematic representation of the bellows features of the seventh example footwear article, in accordance with one or more embodiments of the present disclosure.

Looking briefly to FIG. 18, FIG. 18 shows a schematic representation 1800 of bellows features of the seventh example footwear article, in accordance with one or more embodiments of the present disclosure. As may be seen in FIG. 18, a top surface 1418 of the quadrilaterals is formed to follow a direction of manipulation. For example, top surface 1418 of the quadrilateral 1412 is formed such that the top surface 1418 creates a concave formation when undergoing flexion 1414. That is, the top surface 1418 includes a crater when manipulated to be flexed, as indicated by arrows 1414. In contrast, the top surface 1418 of the quadrilateral is formed such that the top surface is convex when undergoing extension 1416. That is, the top surface 1418 bulges outward responsive to extension 1416, as indicated by arrows 1416. As may be seen at FIG. 19, which shows a schematic representation 1900 of the bellows features of the seventh example footwear article, the top surfaces 1418 of the quadrilaterals 1412 are concave as their home position. That is, when not undergoing flexion or extension, the top surfaces 1418 of the quadrilaterals 1412 are concave.

Figure 20:
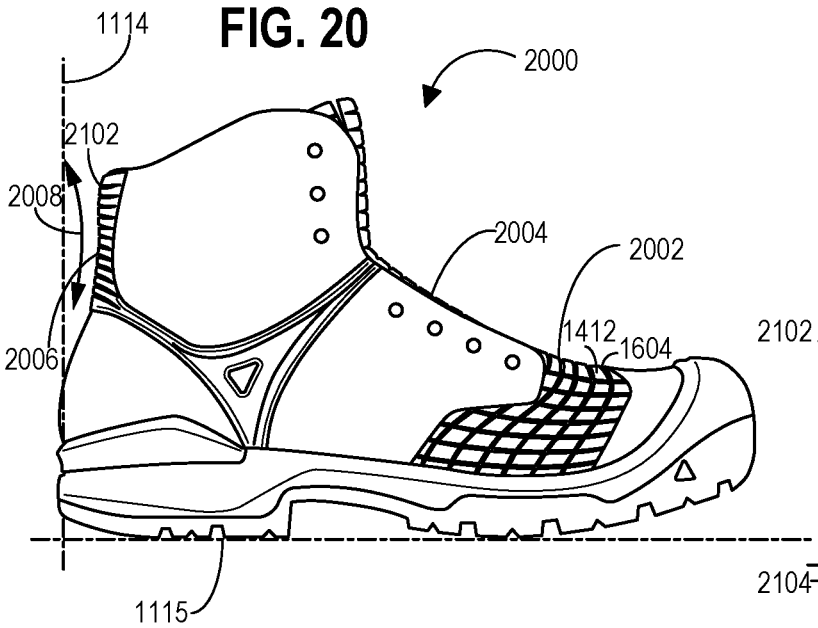
FIG. 20 shows a side view of an eighth example footwear article, in accordance with one or more embodiments of the present disclosure.
Figure 21:
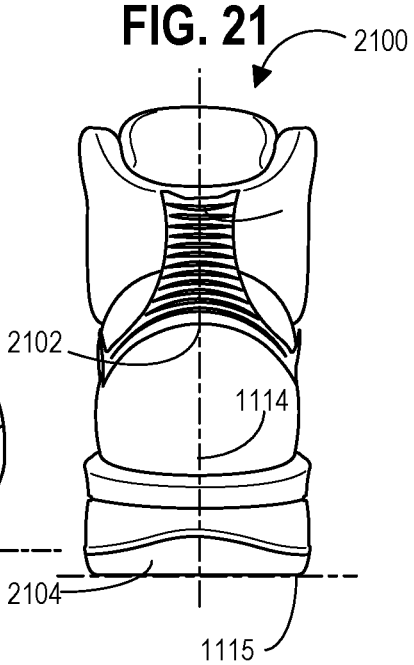
FIG. 21 shows a rear view of the eighth example footwear article, in accordance with one or more embodiments of the present disclosure.

Turning now to FIG. 20, FIG. 20 shows a side view of an eighth example footwear article 2000, according to one or more examples of the present disclosure. As may be seen in FIG. 20, the footwear article includes a wear guard 2002 that may be positioned at the vamp, including the metatarsal phalangeal joint region 101. Wear guard 2002 may include a similar gird configuration as discussed at FIGS. 14-19. The footwear article may further include one or more of a flexion wear guard 2004 positioned on the tongue of the footwear article and a heel wear guard 2006 positioned at a heel region of the footwear article. Looking briefly to FIG. 21, which shows a rear view of the eighth example footwear article 2100, the heel guard 2006 comprises a plurality of bellows features in a curved slit formation, where splines 2102 closest to the outsole 2104 curve in a direction away from the outsole. As the splines 2102 are further away from the outsole, a curvature of the splines 2102 gradually inverts and eventually curves in a direction towards the outsole 2104. As may be seen at FIG. 20, splines 2102 may help to provide structure while still enabling flexion of the heel guard 2006 when flexed, as indicated by 2008. The flexion wear guard 2004 may include a spline configuration as discussed in detail at FIG. 22.

Figure 22:
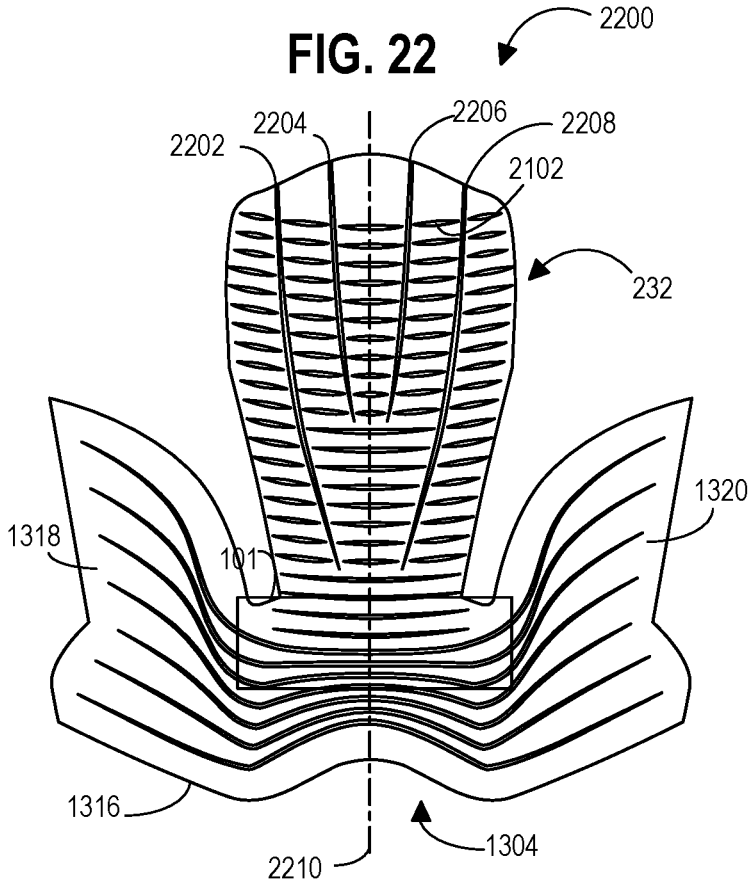
FIG. 22 shows a bellows configuration of a ninth example footwear article, in accordance with one or more embodiments of the present disclosure.
Figure 23:
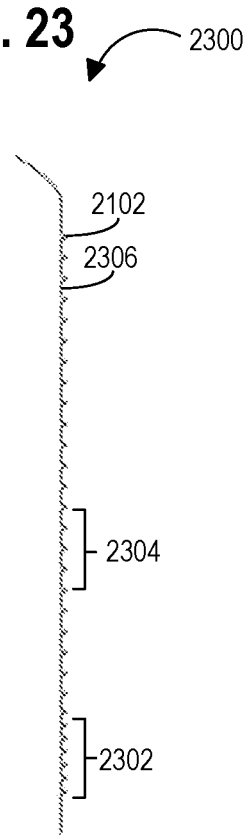
FIG. 23 shows a profile view of the bellows configuration of the ninth example footwear article, in accordance with one or more embodiments of the present disclosure.

Turning to FIG. 22, it shows a bellows configuration of a ninth example footwear article 2200, in accordance with one or more embodiments of the present disclosure. As may be seen in FIG. 22, the bellows configuration includes a plurality of splines 2102 of various sizes and curvatures. Additionally, a plurality of slits 2202, 2204, 2206, 2208 are formed into the bellow configuration, the plurality of slits substantially perpendicular to at least a portion of the plurality of splines 2102. It is noted that the slits and splines are symmetrical about medial axis 2210 of the bellows configuration. The slits 2202, 2204, 2206, 2208 each extend along a length of tongue 232 and curve inwards towards the medial axis 2210. Moreover, it is noted that at length and curvature of splines 2102, as well as a spacing between the plurality of splines is varied to accommodate particular movements of the footwear article. That is, the spacing, length, and particular curvature of splines 2102 at FIG. 22 achieves particular movement advantages. For example, FIG. 23 shows a profile view of the bellows configuration of the ninth example footwear article 2300. As seen at FIG. 23, a spacing between the splines 2102 at region 2302, which is near a toe side edge 1316 of the bellows configuration at FIG. 22, is smaller compared to the spacing between the splines 2102 at region 2304, which is positioned on the tongue 232. This is not least more flexibility is needed at region 2302 than at region 2304. Moreover, the degree of curvature at the medial panel 1304 of FIG. 22 differs from the curvature higher up on tongue 232 to enable increased flexion.

Figure 24:
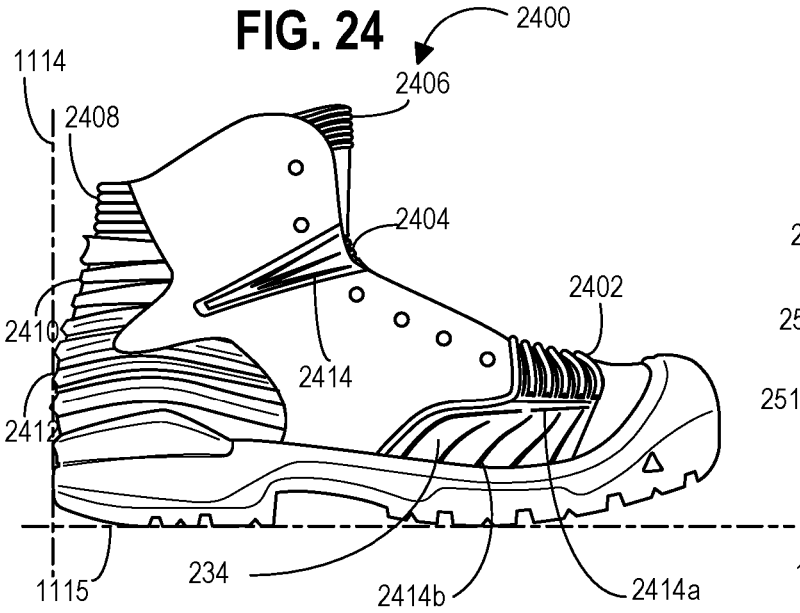
FIG. 24 shows a side view a tenth example footwear article, in accordance with one or more embodiments of the present disclosure.

Turning now to FIG. 24, FIG. 24 shows a side view of a tenth example footwear article 2400. As seen at FIG. 24, the footwear article includes a wear guard 2402 that may be positioned at the vamp, including the metatarsal phalangeal joint region 101. Additionally, the footwear article includes a first flexion wear guard 2404 and a second flexion wear guard 2406 both positioned on a tongue 232 of the footwear article. Further, a first heel guard 2408, second heel guard 2410, and third heel guard 2412 may be included for the footwear article at FIG. 24. Looking briefly to FIG. 25, FIG. 25 shows a rear view of the tenth example footwear article 2500.

Figure 25:
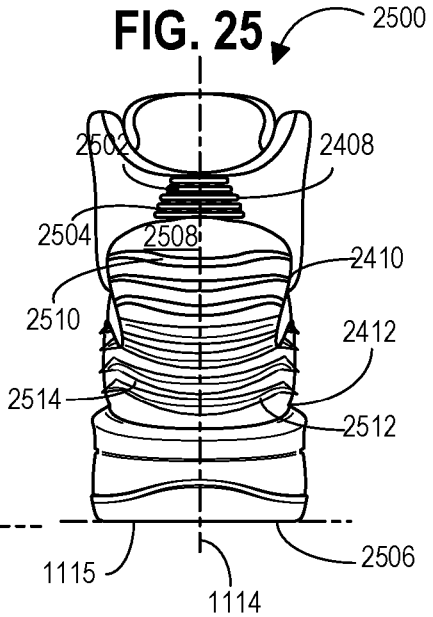
FIG. 25 shows a rear view of the tenth example footwear article, in accordance with one or more embodiments of the present disclosure.

As may be seen at FIG. 25, the first heel guard 2408, the second heel guard 2410, and the third heel guard 2412 each comprise a different bellows profile. However, it is contemplated that in one or more examples that only some of the bellows profiles and/or heel guards may be used. In at least one example, the first heel guard 2408 may comprise bellows which are relatively narrow compared to the other bellows of the footwear article, and which are very close together. That is, the peaks 2502 and the valleys 2504 of the bellows at the first heel guard 2408 may be relatively narrow compared to the bellows for the remainder of the footwear article. Moreover, the ridges (peaks 2502) and valleys 2504 of the first heel guard 2408 extend substantially straight and parallel to a bottom of the outsole 2506. A length of each bellows feature (where each bellows feature comprises two valleys and the peak formation there between) is most narrow at a top of the ankle and widest at a position closes to outsole 2506. The formation of the bellows for the first heel guard 2408 may be more flexible compared to a flexibility of the second heel guard 2410 and the third heel guard 2412. Such increased flexibility at the first heel guard 2408, which is at a top of the ankle of the footwear article, may enable the footwear article to more easily be put on or taken off.

The second heel guard 2410 comprises a bellows configuration where peaks 2508 may vary in shape from each other. For example, an uppermost peak 2508, which is immediately adjacent the first heel guard 2408, is wider than the remaining peaks 2508 of the second heel guard 2410. Further, as seen at FIG. 24, the side profile of the uppermost peak (labeled 2508 in FIG. 25) for the second heel guard 2410 differs in shape and curvature as compared to the remaining peaks 2508 of the second wear guard 2410. In particular, the uppermost peak may be shaped to allow the uppermost peak to easily compress downward towards the remaining peaks. Such a shaping may be a cost effective stitching and layer option for creating structure and flexibility.

As to the third heel guard 2412, the third heel guard 2412 includes bellows with peaks 2512 which are in a raised bar configuration between valleys 2514.

Figure 26:
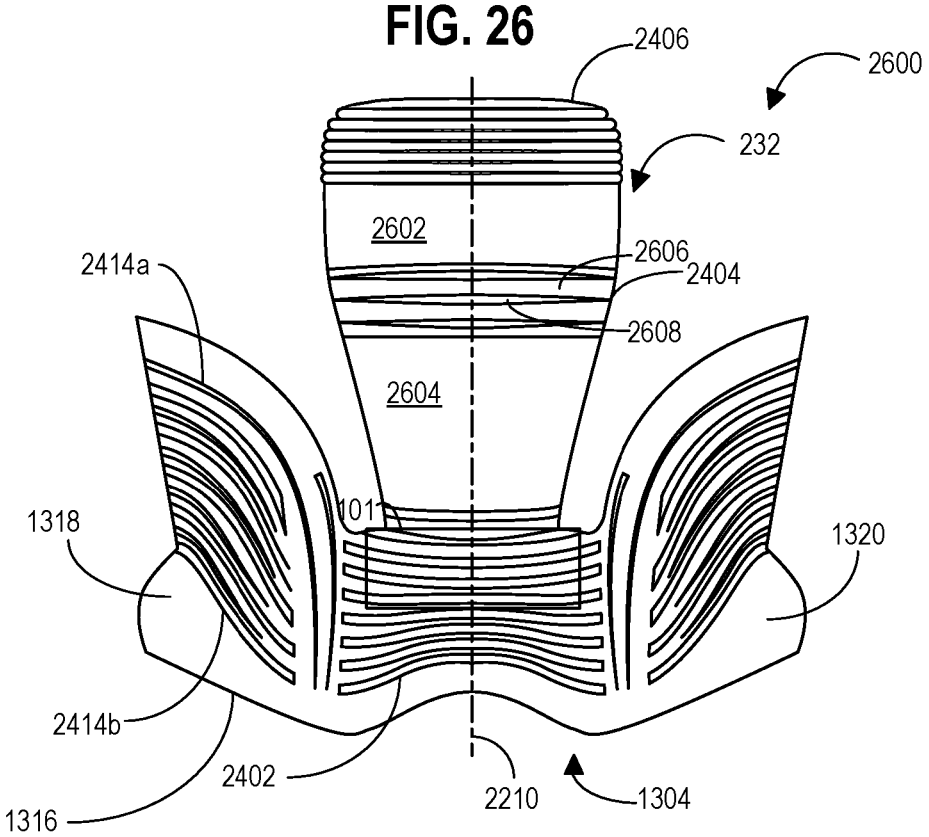
FIG. 26 shows a bellows configuration of the tenth example footwear article, in accordance with one or more embodiments of the present disclosure.

It is noted that any of the bellows described at FIGS. 24-26 may have a profile similar to the raised bar bellows profile discussed at FIG. 10D of the present disclosure, for example. In the raised bar profile may have a capsule shape which provides flexibility and stability.

For example, looking back to FIG. 24 any one or combination of wear guard 2402, first flexion guard 2404, second flexion guard 2406, and the heel guards 2408, 2410, and 2412 may include a raised bar configuration such as shown at FIG. 10D. The footwear article may further include one or more of a flexion wear guard 2004 positioned on the tongue of the footwear article and a heel wear guard 2006 positioned at a heel region of the footwear article.

Continuing with FIG. 24, as may be seen, wing 1318 may be a region which comprises depressed grooves, including at least one perimeter groove 2414*a* and one or more transverse grooves 2414*b*. Further grooves 2414 may further be formed at an ankle flexion region of the upper. The wing 1318 may further be configured without any raised bars to assist in in flexing and thus only include recessed grooves. In particular, as seen at FIG. 26 which shows a bellows configuration of the tenth example footwear article 2600, grooves 2414*a*, 2414*b* are positioned in wing 1318 without any bars.

As may further be seen at FIG. 26, the bellows configuration may include a first panel 2602 and a second panel 2604 of tongue 232, which do not include any bellows formations therein. Moreover, it can be seen that first flexion guard 2404 comprises a bellows configuration with peaks 2606 and valleys 2608.

Figure 27:
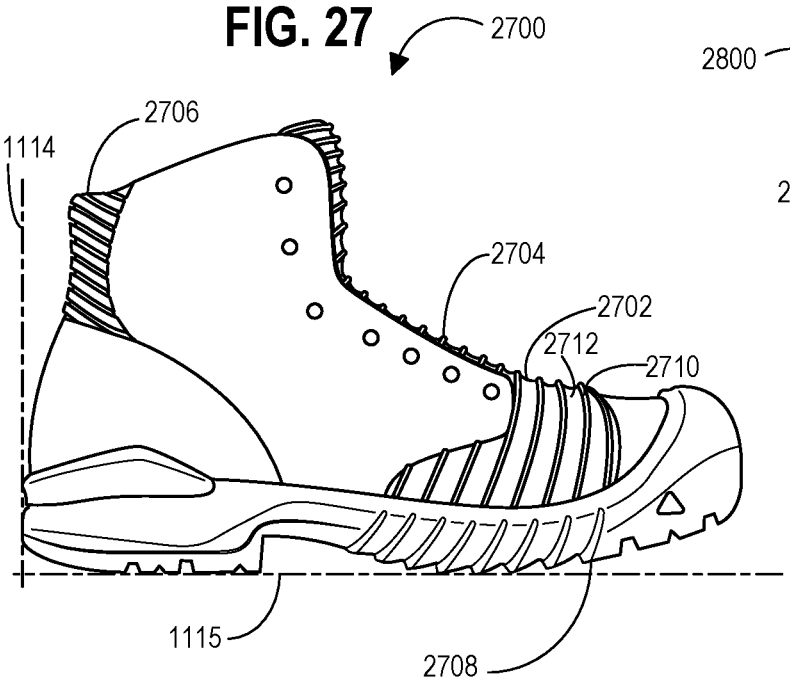
FIG. 27 shows a side view an eleventh example footwear article, in accordance with one or more embodiments of the present disclosure.
Figure 28:
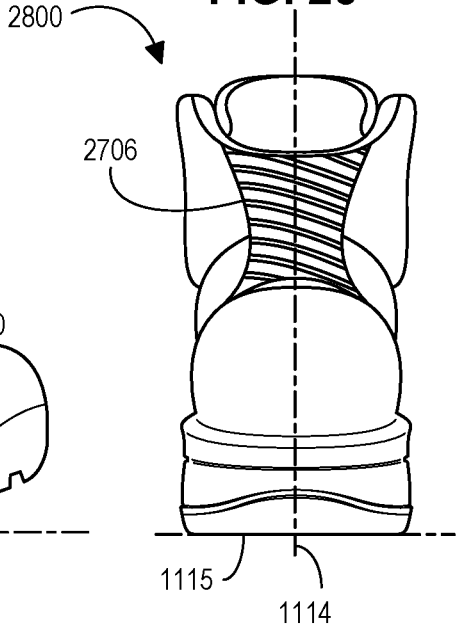
FIG. 28 shows a rear view of the eleventh example footwear article, in accordance with one or more embodiments of the present disclosure.
Figure 29:
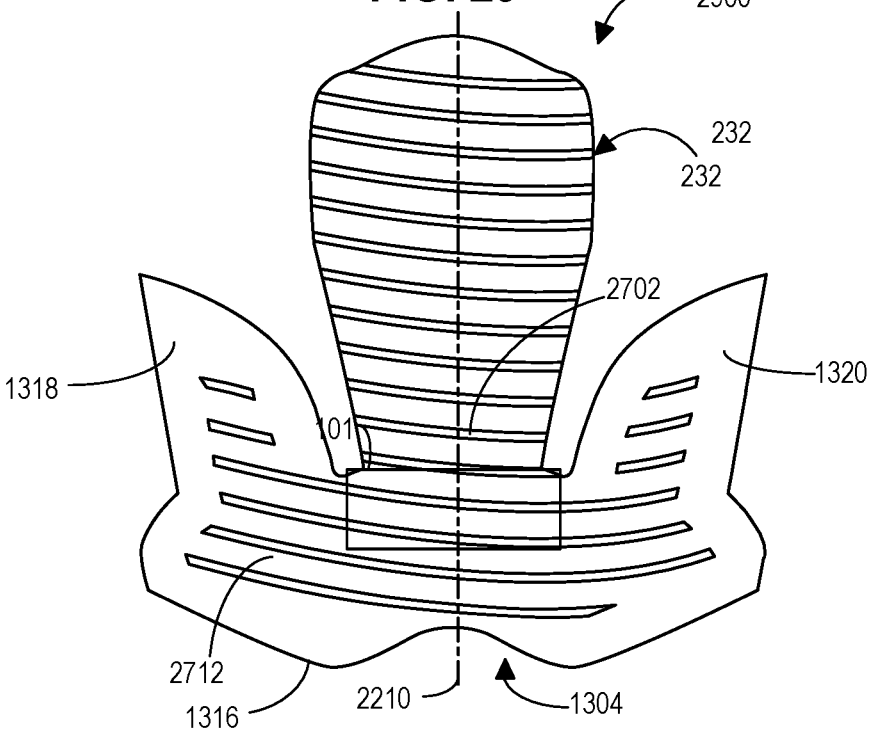
FIG. 29 shows a bellows configuration of the eleventh example footwear article, in accordance with one or more embodiments of the present disclosure.

Turning now to FIG. 27, FIG. 27 shows a side view of an eleventh example footwear article 2700. As may be seen at FIG. 27, the footwear article includes a wear guard 2702 that may be positioned at the vamp, including the metatarsal phalangeal joint region 101 (see FIG. 29). Additionally, a flexion wear guard 2704 is positioned on a tongue of the footwear article and a heel guard 2706 is positioned at a heel of the footwear article. Looking briefly to FIG. 28, which shows a rear view of the eleventh example footwear article 2800, the heel guard 2706 may be a single piece heel guard in at least one example. Looking back to FIG. 27, it is noted that an outsole wear guard 2708 may further be included.

The bellows formation of the wear guards at FIG. 27 (2702, 2704, 2706, 2708) include peaks 2710 and valleys 2712 which may be similar to the bellows profile at FIG. 10E, in at least one example. It is noted that each wear guard piece at FIG. 27 includes bellows which all extend at substantially the same angle. For example, as may be seen at FIG. 28, the heel guard 2706 bellows all extend at the same angle and are part of the same piece. Further, as may be seen at FIG. 29, which shows a bellows configuration of the eleventh example footwear article 2900, the bellows all extend at the same angle and are part of a single piece. The wear guard may be molded such that a shaping of the bellows is convex. The bellows formation at FIGS. 27-29 may be similar to a flexible tube, in at least one example. Moreover, though the footwear article is shown with portions of the upper not comprising the bellows formation, it is noted that in at least one example the entire upper may be made of the bellows formation shown at FIGS. 27-29.

Figure 30:
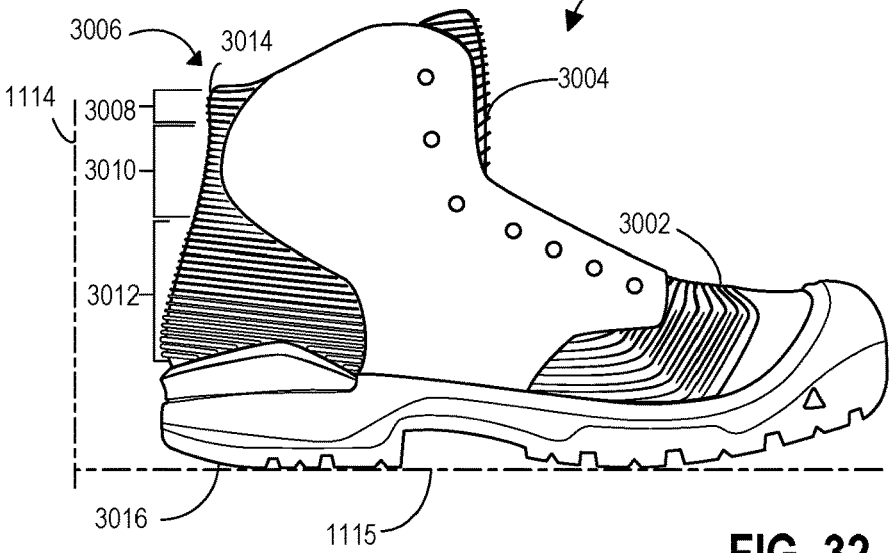
FIG. 30 shows a side view of a twelfth example footwear article, in accordance with one or more embodiments of the present disclosure.

Turning now to FIG. 30, FIG. 30 shows a side view of a twelfth example footwear article 3000. As may be seen at FIG. 30, the footwear article includes a wear guard 3002 that may be positioned at the vamp (including the metatarsal phalangeal joint region), a flexion wear guard 3004, and a heel wear guard 3006. The bellows at the heel may be in the form of fins at FIG. 30, with a thickness and depth of the fins adjusted for increasing and decreasing flexibility of the footwear article. For example, looking at a first region 3008 of the heel guard 3006, the fins 3014 (also referred to herein as bars) extend outwards to create a pull tab. Thus, the first region 3008 may also be referred to as a pull zone.

Looking now to second region 3010 of heel guard 3006, fins 3014 are set inwards to reduce material thickness and increase flexibility. Thus, the second region 3008 may also be referred to herein as the flex zone.

As to the third region 3012 of heel guard 3006, fins 3014 extend outwards and are increased in thickness relative to the other fins of the heel guard 3006. The fins 3014 further increase in thickness within the third region 3012 itself the closer to the outsole 3016 fins 3014 are. Such increased thickness advantageously adds structure to the footwear article. Thus, the third region 3012 may be called the structure zone in at least one example.

In at least one example the wear guard 3002 includes a bellows formation such as shown at FIGS. 8 and 9. However, in at least one example, a combination of the bellows configurations discussed herein, including the fins 3014, may be incorporated into the wear guard 3002.

Figure 31:
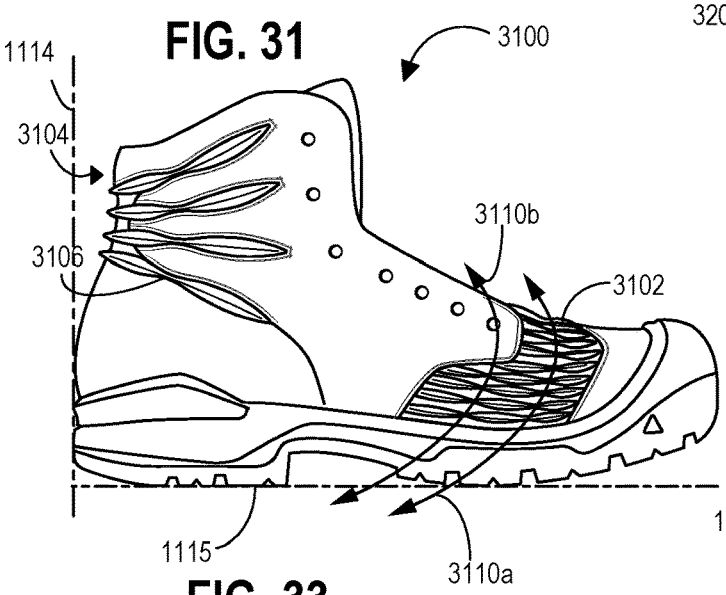
FIG. 31 shows a side view of a thirteenth example footwear article, in accordance with one or more embodiments of the present disclosure.
Figure 32:
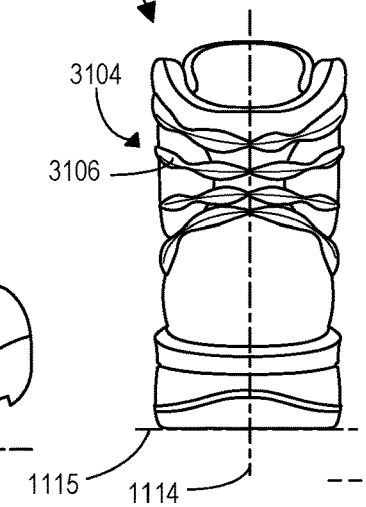
FIG. 32 shows a rear view of the thirteenth example footwear article, in accordance with one or more embodiments of the present disclosure.

Turning now to FIG. 31, FIG. 31 shows a side view of a thirteenth example footwear article 3100. As may be seen at FIG. 31, the footwear article includes a wear guard 3102 that may be positioned at the vamp, including the metatarsal phalangeal joint region (labeled 101 in FIG. 33). A heel guard 3104 may additionally be included. The wear guard 3102 and the heel guard 3104 may comprise a bellows configuration in the form of a plurality of finger projections 3106 for structural support while still retaining flexibility. For example, as seen at FIG. 32, a plurality of finger projections 3106 are arranged in a configuration which wraps around the heel for added structural support while retaining flexibility.

Each of the finger projections 3106 may have varied heights, including approximately a height of 0.0 mm Where the height is approximately 0.0 mm, the finger projections 3106 are able to be flexed. Thus, such locations where the height is approximately 0.0 mm are referred to as flex points (see 3108 at FIGS. 34-35) of the finger projections 3106.

Figure 34:
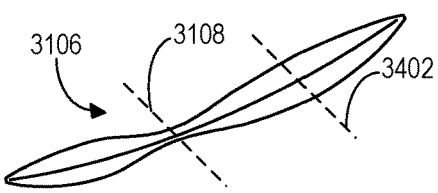
FIG. 34 shows a schematic representation of the topography for the bellows configuration of the thirteenth example footwear article, in accordance with one or more embodiments of the present disclosure.
Figure 35:
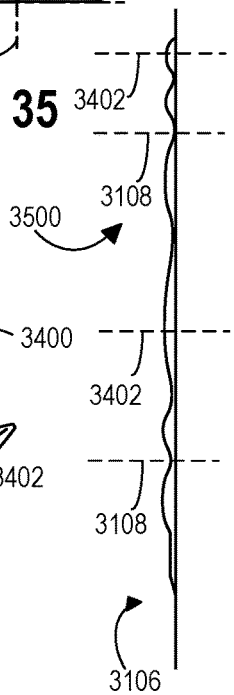
FIG. 35 shows a profile view of the bellows configuration of the thirteenth example footwear article, in accordance with one or more embodiments of the present disclosure.

Looking briefly to FIGS. 34 and 35, FIG. 34 shows a schematic representation of the topography for the bellows configuration of the thirteenth example footwear article 3400 and FIG. 35 shows a profile view of the bellows configuration of the thirteenth example footwear article 3500. As may be seen, each finger projection 3106 may include one or more flex points 3108. Additionally, the finger projections 3106 may include structural points 3402, which are peaks of the finger projections 3106. In at least one example, the peak height of the finger projections 3106 may be approximately 3.0 mm. However, other peak heights may also be possible. For example, a peak height of approximately 5.0 mm to 8.0 mm may also be possible.

As may be seen at FIG. 34, a width of the finger projection 3106 increases as a height (also referred to herein as thickness) of the finger projection 3106 increases (height shown in FIG. 35). In this way, maximum structural stability is provided at the structural points 3402, while maximum flexibility is provided at flex points 3108.

Figure 33:
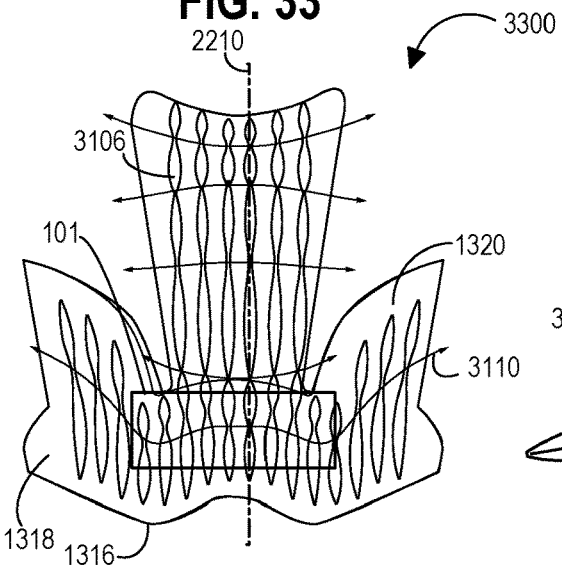
FIG. 33 shows a bellows configuration of the thirteenth example footwear article, in accordance with one or more embodiments of the present disclosure.

In at least one example, flex points 3108 may be aligned to form flex regions 3110 of the footwear article. For example, as shown at FIG. 31, a first flex region 3110*a* and a second flex region 3110*b* are formed along the arrows via the alignment of a plurality of flex points 3108. Similarly, FIG. 33 shows a bellows configuration for the thirteenth example footwear article 3300 in which flex regions 3110 are illustrated along the arrows. It is also noted that as the height of the finger projections 3106 increases as a width of the finger projections 3106 increases, there are further structural regions formed via alignment of the structural points 3402.

Thus, provided herein is a footwear article including a wear guard configuration that prevents degradation of the upper while still enabling flexibility of the shoe. In particular, the footwear article may comprise a flexible vamp wear guard. In this way, the technical effect of reduced degradation of the footwear article while maintaining user comfort and mobility may be achieved. A footwear article in accordance with the present disclosure may comprise an upper, and a wear guard, the wear guard including bellows positioned at a metatarsal phalangeal joint region of the footwear article, wherein the wear guard is a different material than the upper of the footwear article. In a first example of the footwear article, the bellows extend over a vamp of the footwear article. In a second example of the footwear article, which optionally includes the first example, the bellows extend across the metatarsal phalangeal joint region from an outsole at a first side of the footwear article to the outsole at a second side of the footwear article. In a third example of the footwear article, which optionally includes one or both of the first and second examples, the bellows curve back towards a heel of the footwear article. In a fourth example of the footwear article, which optionally includes one or more of the first through third examples, the upper is exposed between a toe cap and the wear guard. In a fifth example of the footwear article, which optionally includes one or more of the first through fourth examples, the wear guard is a single-piece molded structure. In a sixth example of the footwear article, which optionally includes one or more of the first through fifth examples, a heel guard is positioned at a heel of the footwear article, the heel guard including ribs formed therein. In a seventh example of the footwear article, which optionally includes one or more of the first through sixth examples, the toe cap, the wear guard, and the heel guard are an integrated structure. In an eighth example of the footwear article, which optionally includes the first through seventh examples, the bellows overlap with quarter panels of the footwear article.

A second footwear article, which may include one or more features of the footwear article described above, comprises an upper, and a wear guard structured with bellows, wherein the bellows extend along an edge of a lacing structure of the footwear article, the bellows positioned between the lacing structure and a toe of the footwear article. In a first example of the second footwear article, the bellows include one or more transverse grooves. In a second example of the second footwear article, which optionally includes the first example, the one or more transverse grooves curve towards a tongue of the footwear article at region between a toe of the footwear article and a tongue of the footwear article. In a third example of the second footwear article, which optionally includes one or both of the first and second examples, the wear guard extends onto a tongue of the footwear article. In a fourth example of the second footwear article, which optionally includes one or more of the first through third examples, the bellows form ridgelines which curve around quarter panels of the footwear article. In a fifth example of the second footwear article, which optionally includes the first through fourth examples, the wear guard is integrated with the upper.

A third footwear article according to the present disclosure, which may include any one or more of the features described with the above footwear articles, comprises an upper, and a wear guard comprising bellows, wherein the bellows are positioned adjacent a tongue of the footwear article. In a first example of the third footwear article, the bellows extend onto the tongue of the footwear article. In a second example of the third footwear article, which optionally includes the first example, the bellows are positioned between a lacing structure of the footwear article and a toe of the footwear article. In a third example of the third footwear article, which optionally includes one or both of the first and second examples, the third footwear article further comprises a heel guard, the heel guard including a plurality of ribs. In a fourth example of the third footwear article, which optionally includes one or more of the first through third examples, the wear guard is spaced away from an outsole of the footwear article, and wherein the upper forms a portion of an exterior surface of the footwear article between the wear guard and the outsole of the footwear article.

In a fourth footwear article, which optionally includes one or more of the above discussed footwear article features, the footwear article may comprise an upper and a wear guard configuration, the wear guard configuration including a toe cap positioned at a toe of the footwear article and a flexible vamp overlay with bellows positioned at a vamp of the footwear article, wherein the wear guard configuration is a different material than the upper of the footwear article. The inclusion of a flexible vamp overlay with bellows positioned at a vamp of the footwear article may beneficially reduce degradation of the upper of the footwear article while still allowing sufficient mobility for a user. Furthermore, the flexible vamp wear guard being an overlay in the first example footwear article, as opposed to integrated into the upper, may beneficially result in improved user comfort compared to integrating the flexible vamp wear guard into the upper. In a first example of the fourth footwear article, the bellows may comprise pleating including ribs and grooves, in one or more examples. In a second example that optionally includes the first example of the fourth footwear article, the flexible vamp overlay is dimensionally smaller than the vamp of the footwear article. In this way, adding too much additional weight to the footwear article may be avoided.

In a third example that optionally includes one or more of the first and second examples of the fourth footwear article, the wear guard configuration further includes a gap positioned between the toe cap and the vamp overlay. In a fourth example that optionally includes one or more of the first through third examples of the fourth footwear article, the wear guard configuration is a molded structure. In a fifth example that optionally includes any one or more of the first through fourth examples of the fourth footwear article, the wear guard configuration further includes a heel guard positioned at a heel of the footwear article.

In a sixth example that optionally includes any one or more of the first through fifth examples of the fourth footwear article, the toe cap, the flexible vamp overlay with bellows, and the heel guard may be an integrated structure. Such integration of the toe cap, flexible vamp overlay, and the heel guard may result in dispersion of forces applied to the footwear article (e.g., flexion at a vamp of the footwear article) to prevent degradation of the footwear article. Furthermore, such integration of the toe cap, flexible vamp overlay, and the heel guard may prevent degradation of these components themselves.

In a seventh example that optionally includes any one or more of the first through sixth examples of the fourth footwear article, the toe cap, the flexible vamp overlay, and the heel guard are connected to one another via a portion of the wear guard positioned around a perimeter of the footwear article between the upper and an outsole of the footwear article. The portion of the wear guard configuration positioned around the perimeter of the footwear article, also referred to herein as the perimeter (e.g., perimeter 222) of the wear guard configuration may advantageously strengthen a coupling between the upper and the outsole of the footwear article.

In an eighth example of the fourth footwear article, which optionally includes one or more of the first through seventh examples of the fourth footwear article, the fourth footwear article further comprises an upper, a vamp wear guard structured with bellows at a vamp of the footwear article, a toe cap positioned at a toe of the footwear article, the toe cap integral with the vamp wear guard, and a gap positioned between the vamp wear guard and the toe cap, wherein the vamp wear guard and the toe cap are a different material than the upper. In a ninth example of the fourth footwear article, which optionally includes one or more of the first through eighth examples, wherein the vamp wear guard bellows comprises one or more transverse grooves. In a tenth example footwear article, which optionally includes one or more of the first through ninth examples, further comprising a heel cap, and wherein the flexible vamp wear guard, the toe cap, and the heel cap form a single, unitary piece. In an eleventh example footwear article, which optionally includes one or more of the first through tenth examples, the upper may be positioned in the gap of the wear guard configuration, the upper forming an external surface of the footwear article at the gap. In a twelfth example of the fourth footwear article, which optionally includes one or more of the first through eleventh examples, the vamp wear guard structured with bellows may be formed as an overlay on top of the upper.

In a thirteenth example of the fourth footwear article, which optionally includes one or more of the first through twelfth examples, the wear guard configuration may further comprise an extension that extends from the vamp of the footwear article onto a tongue of the footwear article, the extension further structured with bellows. As discussed above, such an extension may advantageously further help to prevent degradation of the upper. The extension may be connected and formed as one piece with the flexible vamp wear guard, in at least one example. In a fourteenth example footwear article, which optionally includes one or more of the first through thirteenth examples, the wear guard extension positioned on the tongue of the footwear article may vertically overlap quarters of the footwear article without being covered by the quarters. In a fifteenth example footwear article, which optionally includes one or more of the first through fourteenth examples, the vamp wear guard structured with bellows may be integrated with the upper.

In a sixteenth example of the fourth footwear article, which optionally includes one or more of the first through fifteenth examples, the footwear article comprises a flexible vamp wear guard comprising bellows, a toe cap coupled to the flexible vamp wear guard, and a gap defined by the flexible vamp wear guard and the toe cap. In a seventeenth example footwear article, which optionally includes one or more of the first through sixteenth examples, the footwear article comprises an upper, wherein a vamp portion of the upper is positioned within the gap. In an eighteenth example footwear article, which optionally includes one or more of the first through seventeenth examples, the footwear article further comprises a tongue, the flexible vamp wear guard may be integral with an extension, and the extension may extend from the flexible vamp wear guard onto a lower portion of the tongue. The inclusion of the extension extending from the flexible vamp wear guard onto the lower portion of the tongue may beneficially prevent wrinkling of the tongue during lacing. Such wrinkling prevention may improve user comfort and further may prevent downstream degradation that could occur as a result of the wrinkling. The extension may further assist in dispersing forces to help prevent degradation of the upper, especially at the vamp.

In a nineteenth example of the fourth footwear article, which optionally includes one or more of the first through the eighteenth examples, both the flexible vamp wear guard and the extension may be formed with bellows and thus include one or more ribs and one or more grooves formed therein. In a twentieth example of a footwear article, which optionally includes one or more of the first through the nineteenth examples, the one or more ribs of the flexible vamp guard are positioned more closely together than the one or more ribs of the extension. Such varied spacing of the ribs and grooves of the bellows as in the twentieth example may advantageously ensure that the footwear article flexes and moves in a manner that is catered to user movement, while still providing substantial structure.

Thus, a footwear article including a flexible vamp wear guard as discussed above may achieve the technical effect of preventing degradation of a footwear article at a vamp region of the footwear article while still allowing flexibility at the vamp may be achieved. Moreover, advantages as to increased longevity of the footwear article while maintaining user comfort and mobility may also be achieved.

It will be appreciated that the configurations and/or approaches described herein are exemplary in nature, and that these specific embodiments or examples are not to be considered in a limiting sense, because numerous variations are possible. The subject matter of the present disclosure includes all novel and nonobvious combinations and subcombinations of the various features, functions, acts, and/or properties disclosed herein, as well as any and all equivalents thereof.

The invention claimed is:

1. A footwear article, comprising:

a wear guard, the wear guard including bellows, wherein the bellows are spaced away from a toe of the footwear article, wherein the wear guard further comprises an extension at a medial portion of the wear guard, wherein the extension extends from a portion of the wear guard at a metatarsal phalangeal joint region of the footwear article towards the toe of the footwear article, and wherein the extension is trapezoidal in shape and is narrower in width than the portion of the wear guard at the metatarsal phalangeal joint region of the footwear article.

2. The footwear article of claim 1, wherein the portion of the wear guard at the metatarsal phalangeal joint region is wider than a lace structure of the footwear article.

3. The footwear article of claim 1, wherein the bellows extend across the metatarsal phalangeal joint region.

4. The footwear article of claim 1, wherein the bellows are integrated into the footwear article.

5. The footwear article of claim 1, wherein the bellows form part of an exterior surface of the footwear article, and wherein further bellows are positioned at a heel end of the footwear article.

6. The footwear article of claim 1, wherein the wear guard is a single-piece molded structure.

7. The footwear article of claim 1, wherein the bellows overlap with quarter panels of the footwear article.

8. The footwear article of claim 1, wherein the wear guard is stitched to the footwear article.

9. The footwear article of claim 1, further comprising a toe guard, wherein a first edge of the wear guard faces the toe guard and a second edge of the wear guard faces a tongue of the footwear article.

10. The footwear article of claim 1, wherein the bellows include one or more transverse grooves, and wherein the bellows in the extension are narrower in width than the bellows at the metatarsal phalangeal joint region of the footwear article.

11. The footwear article of claim 10, wherein the one or more transverse grooves of the wear guard form ridgelines between the toe of the footwear article and a tongue of the footwear article, and wherein each of the bellows continuously extends from a first side of the wear guard to a second side of the wear guard that is opposite the first side.

12. The footwear article of claim 1, wherein the bellows form ridgelines which are adjacent to a lacing structure of the footwear article.

13. A footwear article, comprising:

a wear guard structured with bellows, the bellows extending to an edge of the wear guard, wherein an entire perimeter of the wear guard is spaced away from an outsole of the footwear article, wherein the bellows extend along an edge of a lacing structure of the footwear article, and wherein the bellows are positioned between the lacing structure and a toe of the footwear article.

14. The footwear article of claim 13, wherein the wear guard extends onto a tongue of the footwear article.

15. The footwear article of claim 13, wherein the edge of the wear guard is the perimeter where the wear guard and an upper of the footwear article meet.

16. A footwear article, comprising:

a wear guard, the wear guard comprising bellows, wherein the bellows are positioned adjacent to a tongue of the footwear article, wherein the wear guard further comprises an extension at a medial portion of the wear guard, wherein the extension extends from a portion of the wear guard at a metatarsal phalangeal joint region of the footwear article towards a toe of the footwear article, and wherein the extension is trapezoidal in shape and is narrower in width than the portion of the wear guard at the metatarsal phalangeal joint region of the footwear article, and wherein the bellows extending to an edge of the wear guard, and wherein an entire perimeter of the wear guard is spaced away from an outsole of the footwear article.

17. The footwear article of claim 16, wherein the bellows extend onto the tongue of the footwear article.

18. The footwear article of claim 16, wherein the bellows are positioned between a lacing structure of the footwear article and the toe of the footwear article.

19. The footwear article of claim 16, wherein an upper of the footwear article forms a portion of an exterior surface of the footwear article between the wear guard and a toe cap of the footwear article.

20. The footwear article of claim 16, wherein the wear guard is molded into the footwear article.

* * * * *